US008678370B2

(12) United States Patent
Teshigawara et al.

(10) Patent No.: US 8,678,370 B2
(45) **Date of Patent: *Mar. 25, 2014**

(54) RECORDING APPARATUS AND RECORDING METHOD

(75) Inventors: Minoru Teshigawara, Saitama (JP); Jun Yasutani, Kawasaki (JP); Takeshi Yazawa, Yokohama (JP); Hiroyuki Saito, Yokohama (JP); Takaaki Ishida, Kawasaki (JP); Koichiro Kawaguchi, Yokohama (JP); Toshiro Yoshiike, Kawasaki (JP); Shuichi Tokuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/614,216

(22) Filed: Sep. 13, 2012

(65) Prior Publication Data

US 2013/0010026 A1 Jan. 10, 2013

Related U.S. Application Data

(63) Continuation of application No. 12/544,087, filed on Aug. 19, 2009, now Pat. No. 8,286,960.

(30) Foreign Application Priority Data

Aug. 25, 2008 (JP) ..... 2008-215699

(51) Int. Cl.
*B65H 83/00* (2006.01)

(52) U.S. Cl.
USPC ..... 271/3.14; 271/3.18; 347/16

(58) Field of Classification Search
USPC ..... 271/3.14, 3.18, 3.2; 347/104, 16
See application file for complete search history.

(56) References Cited

U.S. PATENT DOCUMENTS

| | | | | |
|---|---|---|---|---|
| 7,458,655 | B2 * | 12/2008 | Takahashi et al. | 347/19 |
| 7,744,187 | B2 * | 6/2010 | Iwakura | 347/16 |
| 7,857,535 | B2 * | 12/2010 | Takeda et al. | 400/636 |
| 8,235,492 | B2 | 8/2012 | Saito | |
| 8,286,960 | B2 * | 10/2012 | Teshigawara et al. | 271/3.14 |
| 2004/0085590 | A1 * | 5/2004 | Thiessen | 358/3.24 |

* cited by examiner

*Primary Examiner* — Michael McCullough
(74) *Attorney, Agent, or Firm* — Canon USA, Inc., IP Division

(57) ABSTRACT

A recording apparatus to record an image on a recording medium using a recording head includes a first conveying roller, a second conveying roller, and a controller. The first conveying roller is positioned upstream of the recording head in a conveying direction and the second conveying roller is positioned downstream of the recording head in the conveying direction. In response to a first conveying mode being selected, the controller performs a rotational phase control in which the controller controls rotational phases of the first conveying roller and the second conveying roller such that the recording medium is conveyed by predetermined sections of circumferences of the first conveying roller and the second conveying roller when a trailing end of the recording medium passes the first conveying roller. In response to the second conveying mode being selected, the controller does not perform the rotational phase control.

24 Claims, 33 Drawing Sheets

| | CORRECTION VALUE | | |
|---|---|---|---|
| | CONVEYING ROLLER AREA | EJECTION ROLLER AREA | SHEET PASSING TIME |
| S1 | SLF1 | SEJ1 | SK1 |
| S2 | SLF2 | SEJ2 | SK2 |
| S3 | SLF3 | SEJ3 | SK3 |
| S4 | SLF4 | SEJ4 | SK4 |
| S5 | SLF5 | SEJ5 | SK5 |
| S6 | SLF6 | SEJ6 | SK6 |
| S7 | SLF7 | SEJ7 | SK7 |
| S8 | SLF8 | SEJ8 | SK8 |

| | CORRECTION VALUE | | |
|---|---|---|---|
| | CONVEYING ROLLER AREA | EJECTION ROLLER AREA | SHEET PASSING TIME |
| S1 | SLF1 | SEJ1 | SK1 |
| S2 | SLF2 | SEJ2 | SK2 |
| S3 | SLF3 | SEJ3 | SK3 |
| S4 | SLF4 | SEJ4 | SK4 |
| S5 | SLF5 | SEJ5 | SK5 |
| S6 | SLF6 | SEJ6 | SK6 |
| S7 | SLF7 | SEJ7 | SK7 |
| S8 | SLF8 | SEJ8 | SK8 |

FIG. 23

| TYPE OF RECORDING SHEET | RECORDING QUALITY | | |
|---|---|---|---|
| NORMAL PAPER | HIGH SPEED | NORMAL | HIGH QUALITY |

| NUMBER OF RECORDING PATHS | 1 | 2 | 4 |
|---|---|---|---|
| FIRST CONVEYANCE AMOUNT CONTROL | ON | OFF | OFF |
| SECOND CONVEYANCE AMOUNT CONTROL | OFF | ON | ON |

FIG. 25

| TYPE OF RECORDING SHEET | RECORDING QUALITY | | |
|---|---|---|---|
| NORMAL PAPER | HIGH SPEED | NORMAL | HIGH QUALITY |
| NUMBER OF RECORDING PATHS | 1 | 1 | 4 |
| FIRST CONVEYANCE AMOUNT CONTROL | OFF | ON | OFF |
| SECOND CONVEYANCE AMOUNT CONTROL | ON | OFF | ON |
| BOUNDARY DECIMATION PROCESS CONTROL | OFF | ON | OFF |

FIG. 31A

| TYPE OF RECORDING SHEET | RECORDING QUALITY | | |
|---|---|---|---|
| PHOTO PAPER (GLOSSY) | HIGH SPEED | NORMAL | HIGH QUALITY |

| NUMBER OF RECORDING PATHS | 3 | 5 | 7 |
|---|---|---|---|
| FIRST CONVEYANCE AMOUNT CONTROL | OFF | OFF | OFF |
| SECOND CONVEYANCE AMOUNT CONTROL | ON | ON | ON |

FIG. 31B

| TYPE OF RECORDING SHEET | RECORDING QUALITY | | |
|---|---|---|---|
| PRINTABLE DISC | HIGH SPEED | NORMAL | HIGH QUALITY |

| NUMBER OF RECORDING PATHS | 4 | 6 | 8 |
|---|---|---|---|
| FIRST CONVEYANCE AMOUNT CONTROL | ON | ON | ON |
| SECOND CONVEYANCE AMOUNT CONTROL | OFF | OFF | OFF |

RECORDING APPARATUS AND RECORDING METHOD

CROSS-REFERENCE TO RELATED APPLICATIONS

This application is a continuation of U.S. patent application Ser. No. 12/544,087 filed Aug. 19, 2009 which claims priority to Japanese Patent Application No. 2008-215699 filed Aug. 25, 2008, each of which is hereby incorporated by reference herein in its entirety.

BACKGROUND OF THE INVENTION

1. Field of the Invention

The present invention relates to a recording apparatus and a recording method, and more particularly, to a technique for correcting an error in an amount of conveyance of a recording medium in an inkjet recording apparatus.

2. Description of the Related Art

In general, a high-precision roller obtained by coating a metal shaft with grinder stone is used as a main conveying roller in an inkjet printer. A position detector (a code wheel and an encoder sensor) provided on the main conveying roller is used to control a DC motor. Accordingly, the inkjet printer is capable of conveying a recording medium (sheet) with high accuracy and high-quality images can be recorded. However, there is a limit to increasing the sheet conveying accuracy by increasing the processing accuracy of the conveying roller. To further increase the sheet conveying accuracy, a correction of eccentricity of the roller has recently been performed.

The correction of eccentricity will be briefly explained. If the cross section of the conveying roller is round and the central axis thereof coincides with the rotation axis thereof, a circumferential length (length of arc) corresponding to a rotation of the roller is constant as long as the rotation angle of the roller for conveying the sheet is constant. Therefore, an amount of conveyance of the recording medium which is conveyed while being in contact with the roller is always constant. However, if the cross section of the conveying roller is elliptical, the amount of conveyance varies in accordance with the rotational position (rotational phase) of the roller even if the roller is rotated by a constant angle. More specifically, an area in which the amount of conveyance is larger than a predetermined amount and an area in which the amount of conveyance is smaller than the predetermined amount are provided in accordance with the rotational phase, and an error in the amount of conveyance varies accordingly. In the correction of eccentricity, a correction value for correcting the amount of conveyance is obtained for each rotational phase of the roller, and the error in the amount of conveyance which varies in accordance with the rotational phase is corrected using the correction value. In the following description, the amount of conveyance obtained by rotating the roller by a predetermined angle is also referred to as a unit amount of conveyance.

An ejection roller is positioned downstream of the conveying roller, and is provided with driven rollers called spurs having a star-like shape with pointed projections to convey a sheet on which ink is applied. The ejection roller is composed of a rubber roller made of an elastic member so that the ejection roller does not damage the projections on the spurs. Therefore, even when the correction of eccentricity is performed for the ejection roller, the sheet conveying accuracy cannot be maintained as reliably as that in the case where the correction of eccentricity is performed for the conveying roller.

The sheet conveying accuracy is particularly affected by the amount of conveyance at the time when the sheet is passed from the conveying roller to the ejection roller. In other words, the sheet conveying accuracy at the time when the state in which the sheet is conveyed by both the conveying roller and the ejection roller is switched to the state in which the sheet is conveyed only by the ejection roller is crucial. In the sheet conveying operation at this time, generally, the sheet conveying accuracy decreases from that in the state in which the sheet is conveyed by both the conveying roller and the ejection roller due to various causes, such as bending of a roller shaft and unstable behavior of the sheet which occurs when the sheet is released from the conveying roller, other than the reduction in the roller accuracy. Accordingly, to suppress the reduction in the sheet conveying accuracy at the time when the sheet is passed from the conveying roller to the ejection roller, Japanese Patent Laid-Open No. 2005-7817 discusses a technique for correcting the amount of conveyance at this time by determining a correction value for the amount of conveyance at this time by using a test pattern.

SUMMARY OF THE INVENTION

As described above, due to the eccentricity of the rollers, the error in the amount of conveyance varies in accordance with the rotational phases of the rollers. This also occurs when the sheet is passed between the rollers in the sheet conveying operation. Thus, the error in the amount of conveyance at the time when the sheet is passed between the rollers also varies in accordance with the rotational phase of the conveying roller and the rotational phase of the ejection roller at this time.

However, according to the method described in Japanese Patent Laid-Open No. 2005-7817, the correction value for correcting the amount of conveyance at the time when the sheet is passed from the conveying roller to the ejection roller is fixed, and the fixed correction value is always used in a correction control process for correcting the amount of conveyance in the sheet conveying operation at the time when the sheet is passed between the rollers. Since the rotational phases of the rollers in the sheet conveying operation at the time when the sheet is passed between the rollers differ each time the sheet conveying operation is performed, if the error in the amount of conveyance that occurs when the sheet is passed between the rollers varies in accordance with the rotational phases of the rollers, the error in the amount of conveyance cannot be accurately corrected.

A recording apparatus which records an image on a recording medium by repeating an operation of moving a recording head in a moving direction and a conveying operation of conveying the recording medium in a conveying direction which crosses the moving direction includes a first conveying roller which conveys the recording medium, the first conveying roller being positioned upstream of the recording head in the conveying direction; a second conveying roller which conveys the recording medium, the second conveying roller being positioned downstream of the recording head in the conveying direction; and a controller which controls the conveying operation of conveying the recording medium with the first conveying roller and the second conveying roller. The controller obtains at least one of information showing the type of the recording medium and information showing a recording speed and selectively performs a conveyance control process of controlling rotational phases of the first conveying roller and the second conveying roller in a third conveying operation on the basis of the obtained information, the third conveying operation being performed in a transitional period in which a first conveying operation is switched to a second conveying operation, the recording medium being conveyed by the first conveying roller and the second conveying roller in the first conveying operation and being conveyed by the second conveying roller but not by the first conveying roller in the second conveying operation.

A recording method for recording an image on a recording medium by repeating an operation of moving a recording head in a moving direction and a conveying operation of conveying the recording medium in a conveying direction which crosses the moving direction includes a controlling step of controlling the conveying operation of conveying the recording medium with a first conveying roller which conveys the recording medium and a second conveying roller which conveys the recording medium, the first conveying roller being positioned upstream of the recording head in the conveying direction and the second conveying roller being positioned downstream of the recording head in the conveying direction. In the controlling step, at least one of information showing the type of the recording medium and information showing a recording speed is obtained and a conveyance control process of controlling rotational phases of the first conveying roller and the second conveying roller is selectively performed in a third conveying operation on the basis of the obtained information, the third conveying operation being performed in a transitional period in which a first conveying operation is switched to a second conveying operation, the recording medium being conveyed by the first conveying roller and the second conveying roller in the first conveying operation and being conveyed by the second conveying roller but not by the first conveying roller in the second conveying operation.

According to the present invention, when the sheet is passed from the conveying roller to the ejection roller in the sheet conveying operation, the error in the amount of conveyance can be corrected in accordance with the rotational phases of the rollers, thereby allowing the sheet to be conveyed with high accuracy.

Further features of the present invention will become apparent from the following description of exemplary embodiments with reference to the attached drawings.

BRIEF DESCRIPTION OF THE DRAWINGS

FIG. 23 is a diagram illustrating the relationship between the recording mode and the conveyance-amount control process according to a first embodiment.

FIG. 25 is a diagram illustrating the relationship between whether or not a decimation process is executed and the conveyance-amount control process according to a second embodiment.

FIGS. 31A and 31B are diagrams illustrating the relationship between the type of the recording sheet, the recording quality, the number of recording paths, and the selection of the selected conveyance-amount control process according to a fourth embodiment.

DESCRIPTION OF THE EMBODIMENTS

First Embodiment

Figure 1:
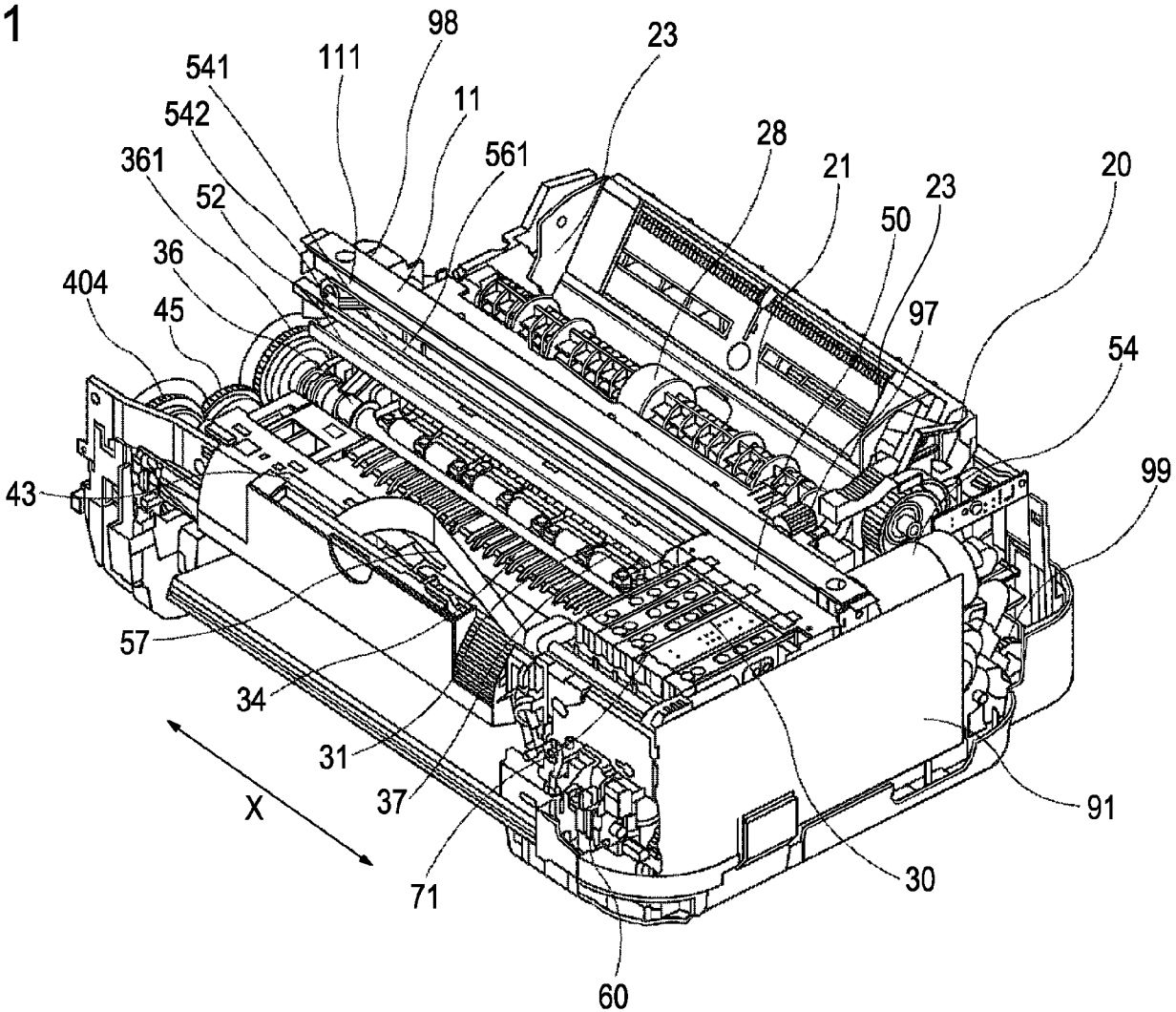
FIG. 1 is a perspective view of a mechanical section of a recording apparatus according to an embodiment of the present invention.

Embodiments of the present invention will be described below with reference to the drawings. FIG. 1 is a perspective view of a mechanical section of a recording apparatus according to an embodiment of the present invention.

A. Sheet Feeding Section

A sheet feeding section includes a pressure plate 21 on which recording media are stacked, a sheet feed roller 28 which feeds recording sheets P one by one, a separation roller (not shown) which separates the recording sheets P from each other, a return lever (not shown) which returns the recording media to the stacking position, etc., all of which are attached to a sheet feeding base 20. Movable side guides 23 are attached to the pressure plate 21 in a movable manner. The position at which the recording media are stacked is regulated by the side guides 23. The pressure plate 21 can rotate around a rotating shaft bonded to the sheet feeding base 20, and is urged toward the sheet feed roller 28 by a pressure-plate spring (not shown). The sheet feed roller 28 is composed of a rod-like member having an arc-shaped cross section, and rotates while being in contact with a surface of the recording media to feed the recording media to the inside of the apparatus. The recording media come into contact with a nip section formed between the sheet feed roller 28 and the separation roller, and are separated from each other in the nip section. Thus, only the topmost recording medium is fed further toward the inside of the apparatus. A force for rotating the sheet feed roller 28 is obtained by transmitting a driving force of a sheet feeding motor 99, which functions as a sheet-feeding drive unit, to the sheet feed roller 28 through a drive transmission gear, a planetary gear, or the like. The driving force of the sheet feeding motor 99 is also transmitted to a cleaning section, which will be described below.

B. Sheet Conveying Section

The main mechanism of a sheet conveying section is attached to a chassis 11 formed by bending a sheet metal and chassis 97 and 98 formed by molding. The recording medium is fed to the sheet conveying section and is guided by a paper guide and a pinch roller holder 30 disposed at an entrance of the sheet conveying section. Then, the recording medium and is held between a conveying roller 36 and pinch rollers 37. The conveying roller 36 is formed by coating a surface of a metal shaft with ceramic microparticles, and includes metal portions at the ends thereof. The metal portions of the conveying roller 36 are supported by bearings attached to the chassis 11. The pinch rollers 37 are held by the pinch roller holder 30 and are urged against the surface of the conveying roller 36 by a pinch roller spring 31. The pinch rollers 37 are in contact with the surface of the conveying roller 36, and are rotated by the rotation of the conveying roller 36.

Figure 2:
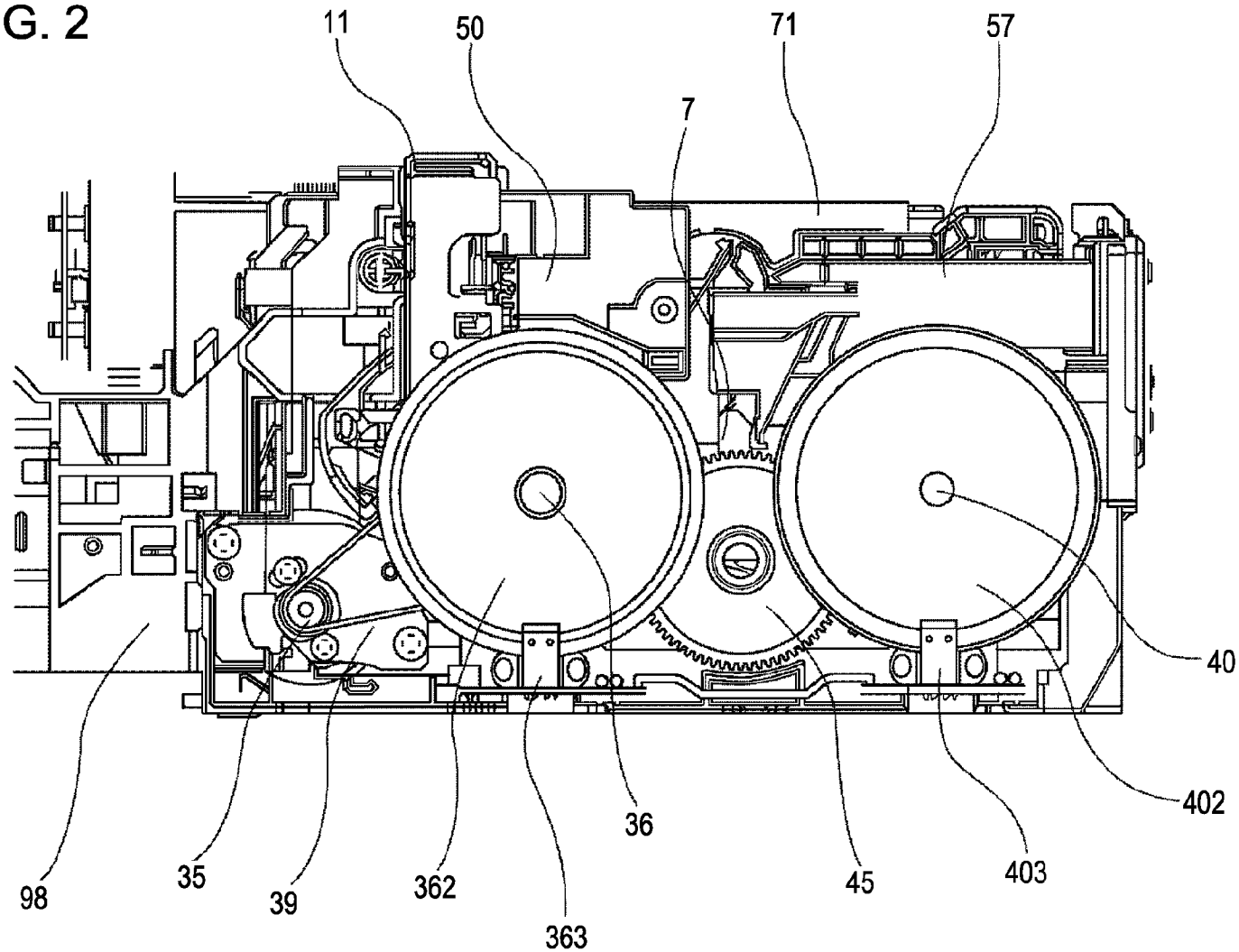
FIG. 2 is a sectional view of a conveying mechanism including a sheet conveying section in the recording apparatus according to the embodiment.
Figure 3:
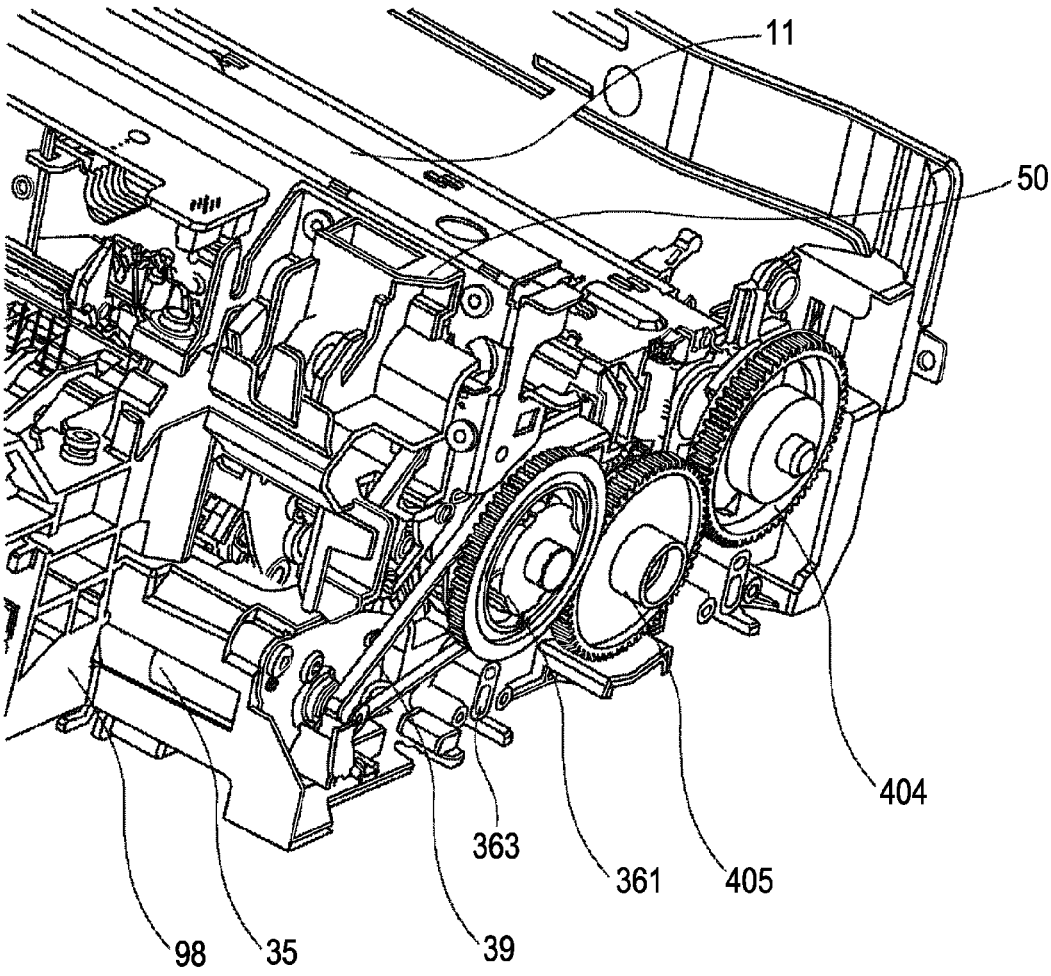
FIG. 3 is a perspective view of the conveying mechanism including the sheet conveying section in the recording apparatus according to the embodiment.

FIGS. 2 and 3 are a sectional view and a perspective view, respectively, of a conveying mechanism including the sheet conveying section in the recording apparatus according to the present embodiment. A force for rotating the conveying roller 36 is obtained by transmitting a driving force of a conveying motor 35, which is a DC motor, to a pulley gear 361 provided on a shaft of the conveying roller 36 through a timing belt 39. A code wheel 362 in which slits are formed at a pitch of 150 lpi to 360 lpi is directly connected to the conveying roller 36 such that the code wheel 362 is coaxial with the conveying roller 36. A conveying-roller encoder sensor 363 is fixed to the chassis 11 at a position shown in FIGS. 2 and 3 such that the conveying-roller encoder sensor 363 can detect the number of times the slits in the code wheel 362 pass the conveying-roller encoder sensor 363 and the times at which the slits pass the conveying-roller encoder sensor 363.

The pulley gear 361 includes a pulley member and a gear member. A driving force is transmitted from the gear member to an ejection roller gear 404 through an idler gear 45, and thus an ejection roller 40 is driven. An ejection-roller code wheel 402 provided with an ejection-roller encoder 403 is disposed on a shaft of the ejection roller 40. The ejection-roller encoder 403 functions as a position detector for detecting the amount of conveyance obtained by the ejection roller 40.

In the present embodiment, the rotational speed ratio between the conveying roller 36 and the ejection roller 40 is 1:1. In addition, the rotational speed ratio is also 1:1 for each of the pulley gear 361, the idler gear 45, and the ejection roller gear 404, which function as a transmitting unit for transmitting a driving force to the conveying roller 36 and the ejection roller 40. With this structure, rotation periods of the conveying roller 36, the ejection roller 40, and transmission gears are equal to each other, and the error in the amount of conveyance caused by the eccentricity of the rollers can be detected at the same period as the rotation period of the rollers.

Referring to FIG. 1 again, when the conveying roller 36 and the pinch rollers 37 are rotated by the conveying motor 35, the recording medium which is held between the conveying roller 36 and the pinch rollers 37 is conveyed in the apparatus. The pinch roller holder 30 is provided with an edge sensor for detecting or positioning the leading and trailing ends of the recording medium. The recording medium is positioned on a platen 34, which is attached to the chassis 11 and located in a recording section, on the basis of the detection result obtained by the edge sensor.

C. Carriage Section

The recording medium is supported by the platen 34 from below at a position downstream of the conveying roller 36, and an image based on recording image information is formed on the recording medium by a recording head 7. The recording head 7 is mounted on a carriage 50 which moves above the recording medium.

The carriage 50 carries the recording head 7 and an ink tank 71 for supplying ink to the recording head 7, and is movable in a moving direction which is shown by X in FIG. 1 and which crosses a conveying direction in which the recording medium is conveyed. The recording head 7 according to the present embodiment includes heaters disposed at positions corresponding to discharge ports, and applies voltage pulses to the heaters so that film boiling occurs. Bubbles are generated as a result of film boiling, and the thus generated bubbles grow or shrink to generate pressure variations which cause the ink to be discharged from the discharge ports. However, the present invention is not limited to the above-mentioned method for discharging ink.

The carriage 50 is supported by a carriage rail 52 and an upper guide rail 111 which extend in a direction perpendicular to the conveying direction of the recording medium. Thus, the direction in which the carriage 50 moves is regulated. The carriage rail 52 is attached to the chassis 11, and the upper guide rail 111 is formed integrally with the chassis 11. The upper guide rail 111 holds the carriage 50 at an end thereof and maintains a gap between a discharge surface of the recording head 7 and the recording medium.

A force for moving the carriage 50 is obtained by transmitting a driving force of a carriage motor 54, which is attached to the chassis 11, through an idle pulley 542 and a timing belt 541 which is stretched around and supported by the idle pulley 542. A code strip 561 on which marks are formed at a pitch of 150 lpi to 300 lpi is disposed so as to extend parallel to the timing belt 541. An encoder sensor (not shown) mounted on the carriage 50 detects the marks while the carriage 50 is being moved. Thus, the current position of the carriage 50 can be detected. A flexible cable 57 follows the reciprocating movement of the carriage 50 and provides an electrical connection between a carriage substrate provided on the carriage 50 and an electric board 91 fixed in the apparatus. A recording signal used in a recording process performed by the recording head 7 is transmitted from the electric board 91 to the carriage substrate through the flexible cable 57. While the recording head 7 is being moved, the heaters provided in the recording head 7 are driven in accordance with the recording signal, so that dots are formed on the recording medium placed on the platen 34.

D. Sheet Ejecting Section

A force for rotating the ejection roller 40 is obtained by transmitting the rotating force of the conveying roller 36 to the ejection roller gear 404, which is directly connected to the ejection roller 40, through the gear member of the pulley gear 361, which is directly connected to the conveying roller 36, and the idler gear 45. Referring to FIG. 2 again, the ejection-roller code wheel 402 is provided on the shaft of the ejection roller 40, and the amount of rotation of the ejection roller 40 is detected by the ejection-roller encoder 403.

A plurality of spurs are attached to a spur holder 43, and are urged toward the ejection roller 40 by a spur spring composed of a rod-like coil spring. The recording medium on which an image is formed by the recording head 7 is conveyed while being nipped between the ejection roller 40 and the spurs, and is ejected.

The sheet ejecting section may include two rollers, and the recording-medium conveying accuracy can be improved in such a case.

Figure 9:
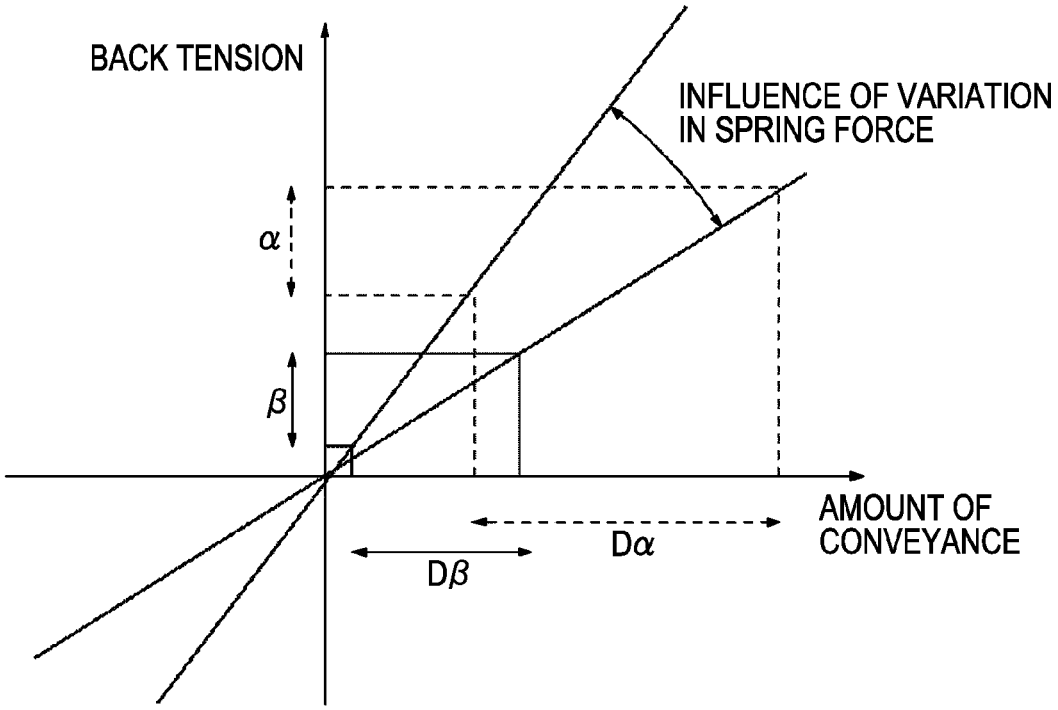
FIG. 9 is a graph illustrating the relationship between the conveyance load and the amount of conveyance in accordance with a pressing force applied to an ejection roller by a spring.

FIG. 9 is a diagram illustrating the manner in which the relationship between the conveyance load (hereinafter also referred to as a back tension) and the amount of conveyance varies in accordance with a pressing force applied to the ejection roller 40 by a spring. The two straight lines shown in FIG. 9 correspond to the relationships between the back tension and the amount of conveyance under different pressing forces.

It is clear from the comparison between the two straight lines that in the case where a certain amount of variation in the back tension occurs due to the component tolerance, variation in the rigidity of the recording medium, etc., the variation in the amount of conveyance which occurs when the absolute value of the back tension is small is smaller than the variation in the amount of conveyance which occurs when the absolute value of the back tension is large.

Figure 10A:
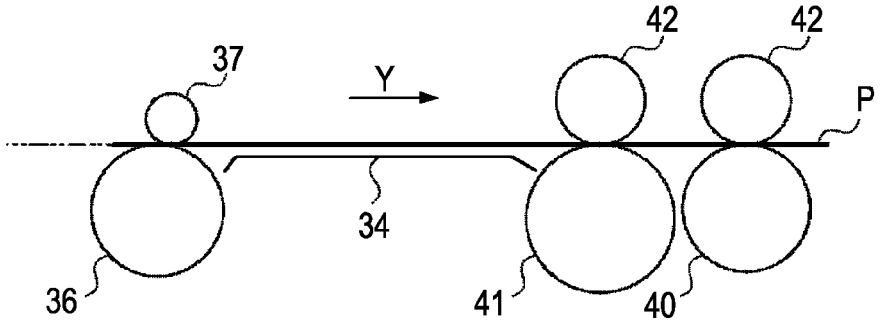
FIGS. 10A and 10B are diagrams illustrating examples of the structures of a sheet ejecting section according to the embodiment.
Figure 10B:
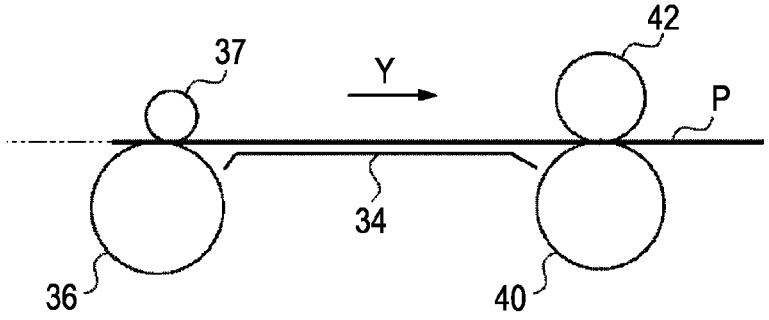

FIGS. 10A and 10B are diagrams illustrating the structure of the sheet ejecting section in which an ejection assist roller (third conveying unit) 41 is provided in addition to the ejection roller (second conveying unit) to make the above-described variation in the amount of conveyance as small as possible. The ejection assist roller 41 serves to cancel the back tension applied to the ejection roller 40, and is positioned upstream of the ejection roller 40 in the conveying direction. To cancel the back tension applied to the ejection roller 40, a peripheral speed of the ejection assist roller 41 is set to be higher than that of the ejection roller 40, which is positioned downstream of the ejection assist roller 41. More specifically, if the ejection roller 40 and the ejection assist roller 41 are rotated at the same rotational speed, the diameter of the ejection assist roller 41 is set to be larger than that of the ejection roller 40 so that the ejection assist roller 41 functions as a speed-increasing system. Therefore, the back tension applied to the ejection roller 40 can be reduced and the influence of the spring pressure of the spurs and the back tension can be suppressed.

To reduce the disturbance applied to the ejection roller 40 due to the conveying force of the ejection assist roller 41, the ejection assist roller 41 is made of a plastic roller having a small coefficient of friction, while the ejection roller 40 is made of rubber. The ejection assist roller 41 also serves to prevent the recording medium from being raised at a recording head section.

For simplicity of explanation, the ejection assist roller 41 will be omitted in the following description and the structure of the sheet-ejecting section including only the ejection roller 40 will be described.

E. Cleaning Section

Referring to FIG. 1 again, a cleaning section 60 includes a pump for cleaning the recording head 7, a cap for preventing the recording head 7 from drying, and a blade for cleaning the discharge surface of the recording head 7. A main driving force for driving the cleaning section 60 is transmitted from the above-described sheet feeding motor 99. The cleaning section 60 performs a suction operation in which waste ink and the like are sucked out of the recording head 7 by activating the pump while the cap is air-tightly attached to the recording head 7. The cleaning section 60 also performs a blade operation in which the surface of the recording head 7 is cleaned by moving the blade.

Figure 4:
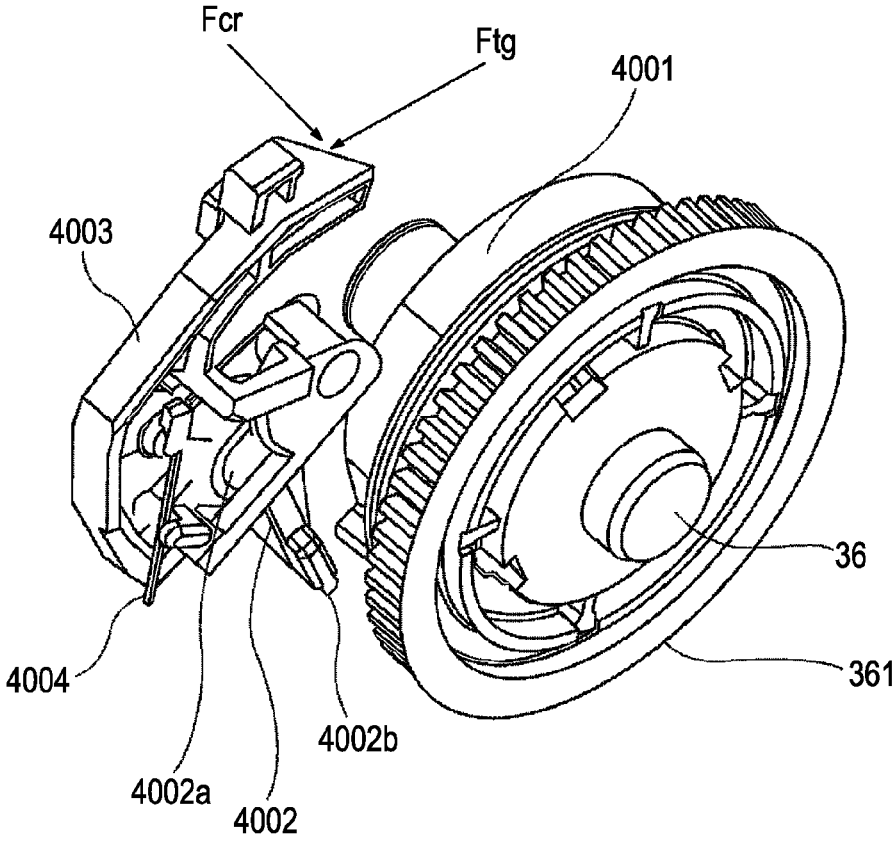
FIG. 4 is a diagram illustrating the structure for detecting an origin of a conveying roller according to the embodiment.
Figure 5:
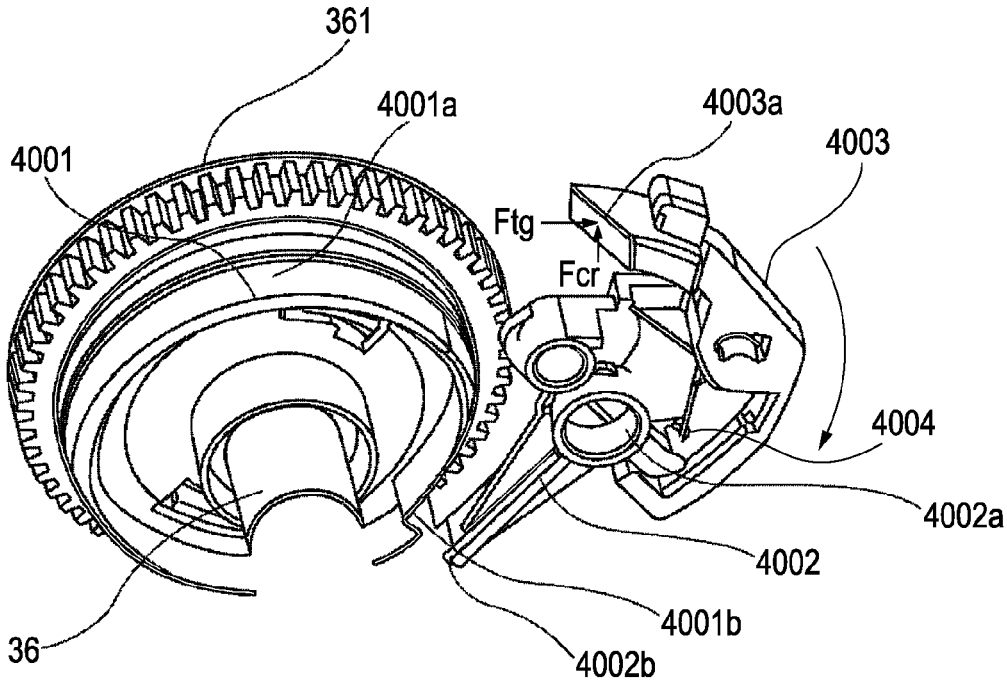
FIG. 5 is another diagram illustrating the structure for detecting the origin of the conveying roller according to the embodiment.

FIGS. 4 and 5 are diagrams illustrating the mechanism for detecting an origin of the conveying roller (first conveying unit) 36 according to the present embodiment. FIG. 4 shows the mechanism viewed from the side of a surface of the pulley gear 361 provided on the conveying roller 36, and FIG. 5 shows the mechanism viewed from the opposite side. A lock ring 4001 is attached to the pulley gear 361. The lock ring 4001 includes a circumferential portion 4001*a* and a recessed portion 4001*b*, and rotates together with the conveying roller 36. A lock lever 4002 rotates around a rotation center 4002*a* and causes a lock portion 4002*b* to abut against the recessed portion 4001*b* of the lock ring 4001 to lock the lock ring 4001. A lock link lever 4003 functions as a lever for pressing or lifting the lock lever 4002. A force for pressing or lifting the lock lever 4002 with the lock link lever 4003 is generated by a lock lever spring 4004. A force Ftg for rotating the lock link lever 4003 is generated when the carriage 50 moves to a lock position (left end in FIG. 1) which is opposite to a home position and outside a scanning area in which the carriage 50 is moved in the recording operation.

Figure 6:
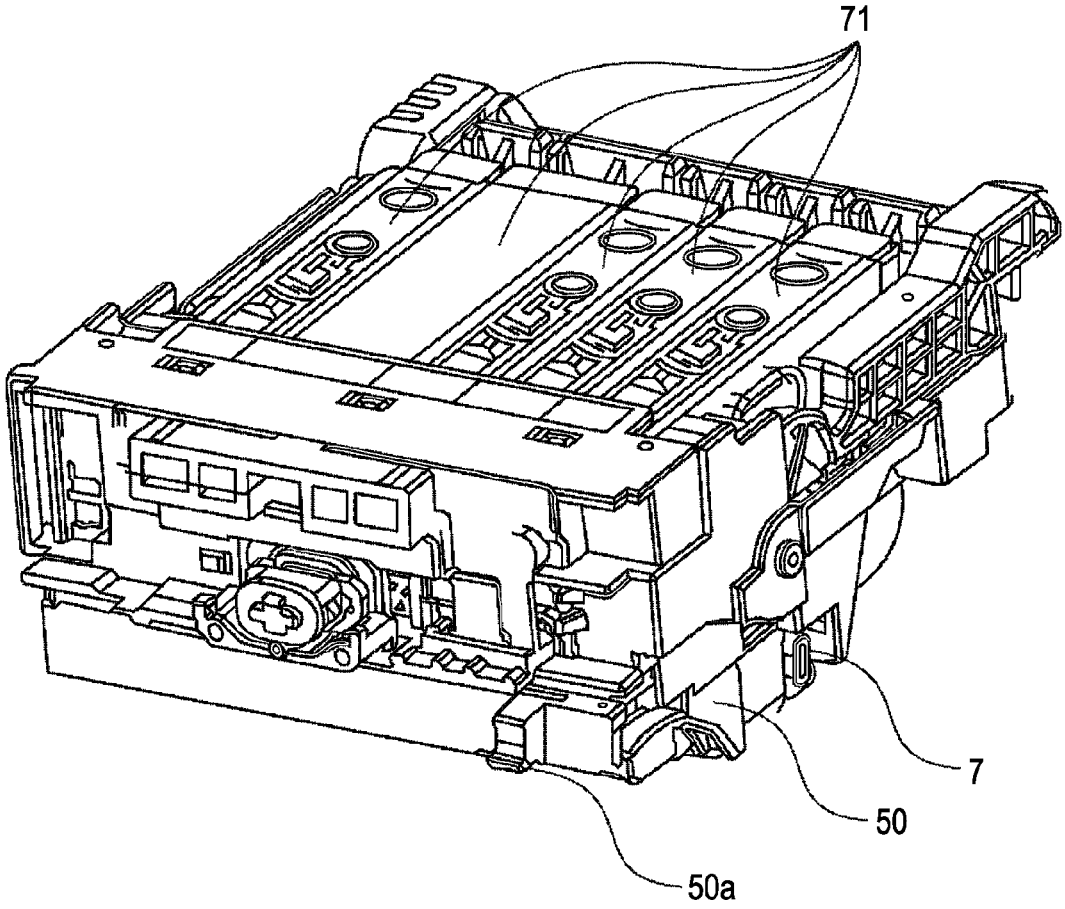
FIG. 6 is a diagram illustrating a carriage included in the recording apparatus according to the embodiment viewed from the back.

FIG. 6 is a diagram illustrating the carriage 50 included in the recording apparatus according to the present embodiment viewed from the back in a direction opposite to the direction in which the recording apparatus is viewed in FIG. 1. A projection 50*a* is attached to a back surface of the carriage 50, and the projection 50*a* comes into contact with an inclined surface 4003*a* of the lock link lever 4003 when the carriage 50 moves to the lock position. When the projection 50*a* comes into contact with the inclined surface 4003*a* of the lock link lever 4003, as shown in FIGS. 4 and 5, a predetermined force Fcr is applied to the inclined surface 4003*a* and the force Ftg for rotating the lock link lever 4003 in the direction shown by the arrow is generated.

Figure 7A:
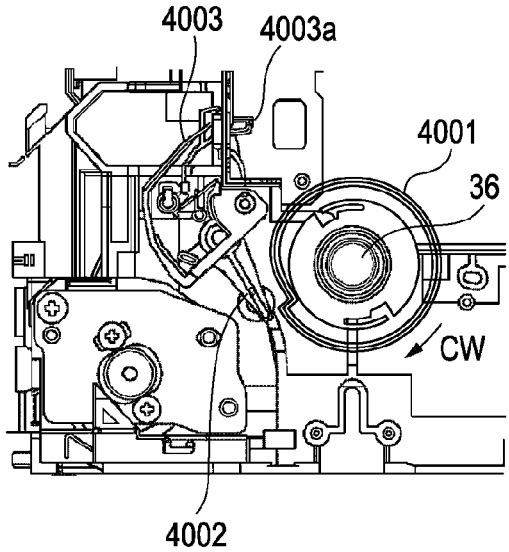
FIGS. 7A to 7C are sectional views illustrating the operation of a lock function provided by the mechanism illustrated in FIGS. 4 to 6.
Figure 7B:
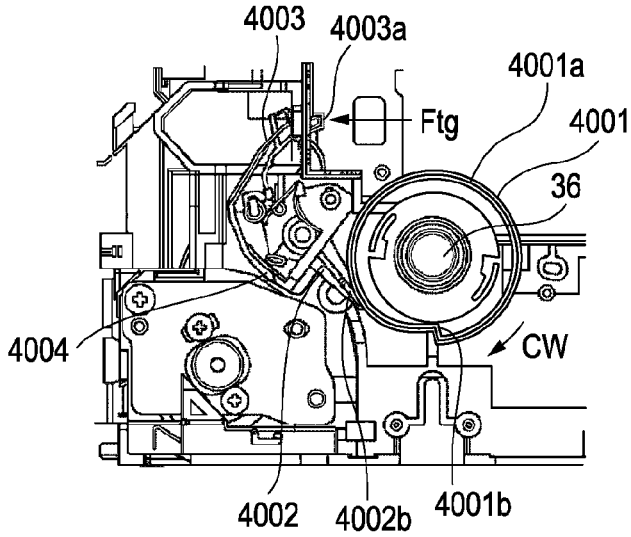
Figure 7C:
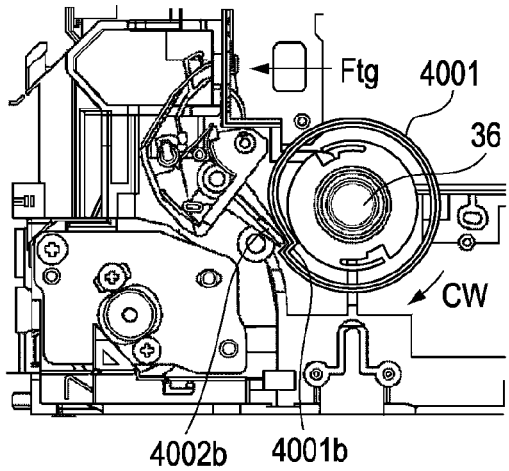

FIGS. 7A to 7C are sectional views illustrating the operation of a lock function provided by the mechanism illustrated in FIGS. 4 to 6.

FIG. 7A shows the state in which the carriage 50 is not at the lock position. In this state, the lock link lever 4003 is not pressed and therefore the lock ring 4001 and the lock link lever 4003 are separated from each other. In the recording operation, the conveying roller 36 and the lock ring 4001 are intermittently rotated in the CW direction shown in FIG. 7A to convey the recording medium.

FIG. 7B shows the state in which the carriage 50 is moved to the lock position and the lock link lever 4003 is pressed by the projection 50*a*, so that a mechanical trigger is activated. More specifically, the force Ftg is generated and the lock link lever 4003 is rotated, so that the lock lever 4002 is brought into contact with the circumferential portion 4001*a* of the lock ring 4001 by the pressing force of the lock lever spring 4004. At this time, if the lock lever 4002 receives a pressure from the circumferential portion 4001*a* of the lock ring 4001, the lock lever 4002 can be moved toward the lock link lever 4003. Therefore, no damage is caused by the impact between the projection 50*a* of the carriage 50 and the lock link lever 4003. In addition, since the lock lever 4002 and the lock link lever 4003 are formed as separate components, the stroke of the lock lever 4002 and the amount of swing of the lock link lever 4003 can be individually set.

FIG. 7C shows the state in which the conveying roller 36 is further rotated from the state shown in FIG. 7B and the rotation of the conveying roller 36 is locked by the lock ring 4001. When the lock ring 4001 is further rotated in the CW direction from the state shown in FIG. 7B while the lock lever 4002 is in contact with the circumferential portion 4001*a* of the lock ring 4001, the lock portion 4002*b* of the lock lever 4002 enters the recessed portion 4001*b* of the lock ring 4001. Accordingly, the lock ring 4001 is restrained from rotating further in the CW direction. In other words, rotation of the lock ring 4001 and the conveying roller 36 is locked. Since the lock ring 4001 is fixed to the pulley gear 361 which transmits the driving force from the conveying motor 35, no rotational force is generated between the conveying roller 36 and the pulley gear 361.

The above-described locked state is obtained at a single rotational position within a single turn of the conveying roller 36. The position at which the conveying roller 36 is locked can be defined as an origin of the phase of the conveying roller 36.

The detection of the origin of the phase of the conveying roller 36 may also be performed by a known method, for example, by using a structure in which an edge mark corresponding to a single period or a single turn is printed on a code wheel and is detected by a sensor or by using a structure in which an edge mark corresponding to a single period or a single turn is attached to a roller or the like and is detected by a sensor.

Figure 8:
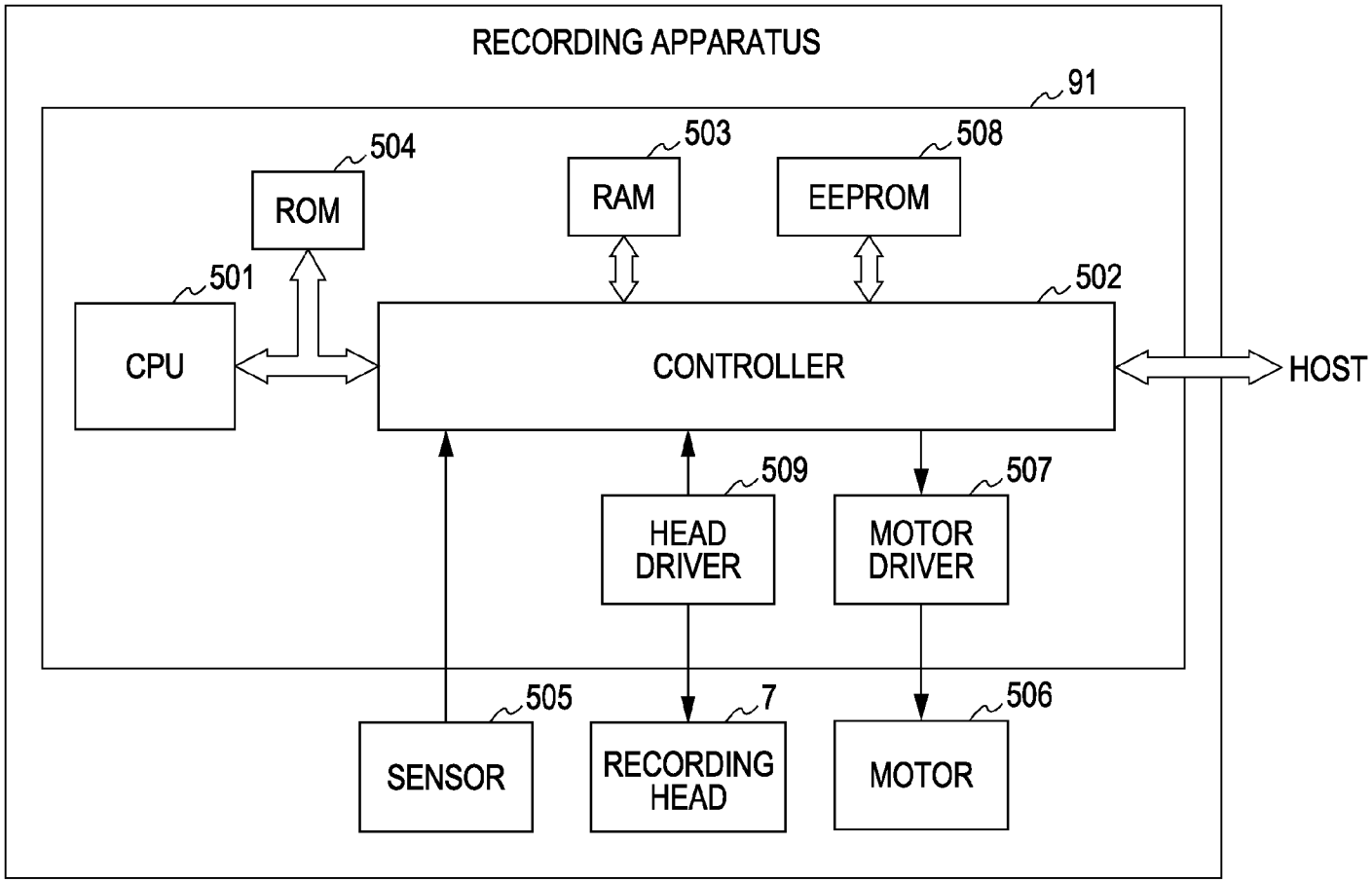
FIG. 8 is an electrical block diagram of the recording apparatus according to the embodiment.

FIG. 8 is a block diagram illustrating the structure of a control system of the recording apparatus according to the present embodiment. A CPU 501 controls various mechanisms in the apparatus through a controller 502 on the basis of various programs stored in a ROM 504. A RAM 503 is used as a work area for temporarily storing various data or for executing processes. Image data is transmitted from an external host apparatus which is connected to the recording apparatus, and the CPU 501 performs an image process for converting the image data into a recording signal with which the recording apparatus can perform the recording operation. Then, various motors included in a motor unit 506 are driven by motor drivers included in a motor driver unit 507 and the recording head 7 is driven by a recording head driver 509 so that an image is formed on the recording medium. In FIG. 8, the motor unit 506 includes all of the conveying motor 35, the carriage motor 54, and the sheet feeding motor 99 which are described above, and the motor driver unit 507 includes the motor drivers thereof.

An electrically erasable programmable read-only memory (EEPROM) 508 stores values set in a factory and data to be updated, and these data are used by the controller 502 and the CPU 501 as control parameters. A sensor unit 505 includes all of temperature sensors, encoder sensors, etc., disposed at various positions in the apparatus, and the above-mentioned conveying-roller encoder sensor 363 is also included in the sensor unit 505. The CPU 501 increments counter information stored in a ring buffer in the RAM 503 each time a slit is detected by the conveying-roller encoder sensor 363. When the origin is detected, origin information is stored in another area in the RAM 503 or in the EEPROM 508.

A characteristic structure of the present embodiment will now be described in detail.

Figure 11A:
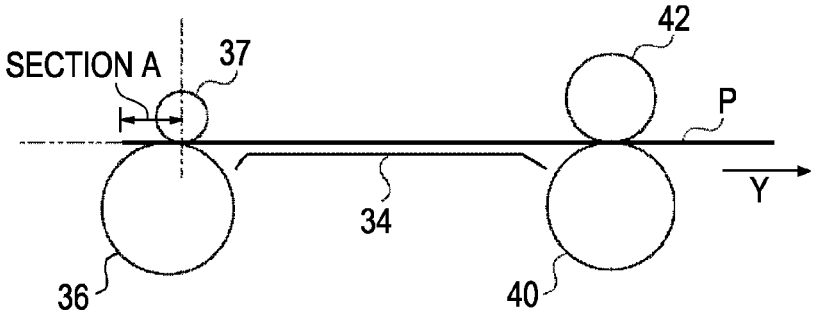
FIGS. 11A to 11C are diagrams illustrating the amount of conveyance of a sheet at the time when the sheet is passed between the rollers according to the embodiment.
Figure 11B:
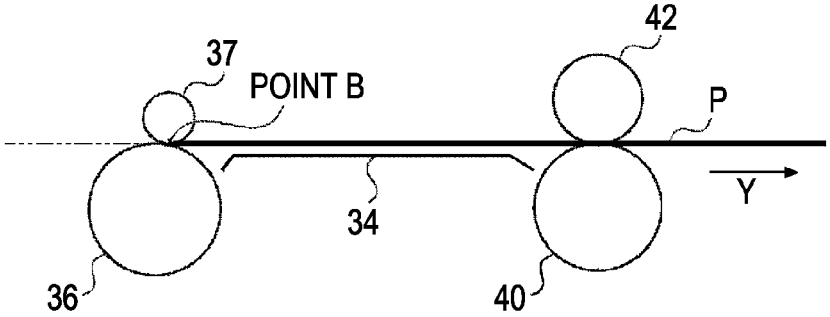
Figure 11C:
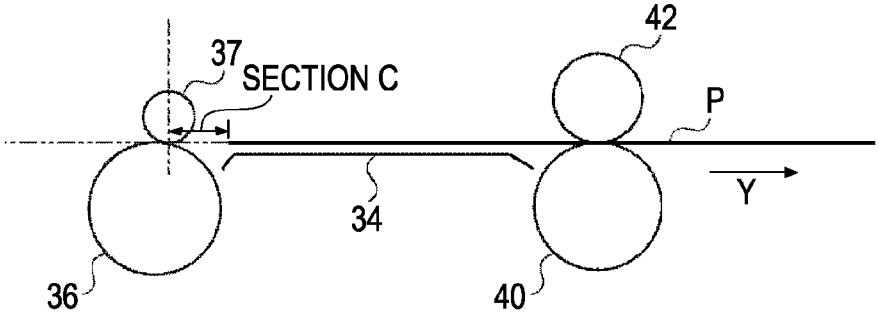

First, the phenomenon that the error in the amount of conveyance varies at the time when the sheet is passed from the conveying roller 36 to the ejection roller 40 will be described. FIGS. 11A to 11C are diagrams illustrating the amount of conveyance at the time when the sheet is passed from the conveying roller 36 to the ejection roller 40.

When the sheet is passed between the rollers in the sheet conveying operation, the state of the sheet becomes unstable if the sheet is stopped at an area near the nip section between the conveying roller 36 and the pinch rollers 37 shown in FIG. 11A. Therefore, it is necessary to perform a conveyance control process such that the sheet does not stop in this area. In other words, when the sheet is passed through the nip section of the conveying roller 36, the sheet is continuously conveyed from a position upstream of the nip section shown in FIG. 11B and is stopped after reaching a position downstream of the nip section, as shown in FIG. 11C. In this process, the area in which the sheet is conveyed includes section A in which the sheet is conveyed by both the conveying roller 36 and the ejection roller 40, point B at which the sheet leaves the nip section, and section C in which the sheet is conveyed only by the ejection roller 40.

Since each of the conveying roller 36 and the ejection roller 40 is eccentric, even when each roller is rotated by a constant angle, there are a range in which the amount of conveyance is large and a range in which the amount of conveyance is small depending on the rotational phase of the roller. In the range in which the amount of conveyance is large, the amount of conveyance obtained when the roller is rotated by a constant angle is large. Therefore, the conveying speed of the sheet is higher than a predetermined speed. In contrast, in the range in which the amount of conveyance is small, the conveying speed is low. Thus, the conveying speed varies at each of the conveying roller 36 and the ejection roller 40 due to the eccentricity thereof. Therefore, there is a difference in the conveying speed between the conveying roller 36 and the ejection roller 40.

As described above, there is a difference in the conveying speed between the conveying roller 36 and the ejection roller 40. Therefore, when the sheet is passed between the rollers and section A is switched to section C in the sheet conveying operation, the amount of conveyance varies due to the difference in the conveying speed between the conveying roller 36 and the ejection roller 40. This will be described in more detail. While the sheet is being conveyed by both the conveying roller 36 and the ejection roller 40, the sheet receives a tensile force or a compressive force in an area between the conveying roller 36 and the ejection roller 40 due to the speed difference between the two rollers. However, when the leading end of the sheet leaves point B, the ejection roller 40 is released from the state in which the ejection roller 40 is bent due to the above-mentioned force. As a result, an amount of conveyance is generated by a specific cause due to the difference in the conveying speed between the conveying roller 36 and the ejection roller 40.

In sections A and C, the amount of conveyance of course includes errors caused by the eccentricities of the rollers. In section A, the role of the conveying roller 36 is dominant in a process of controlling the amount of conveyance, and the error in the amount of conveyance is caused by the eccentricity of the conveying roller 36. In section C, the error in the amount of conveyance is caused by the eccentricity of the ejection roller 40. Therefore, the error (integrated error) corresponding to a unit amount of conveyance in section A and the error (integrated error) corresponding to a unit amount of conveyance in section C must also be taken into account in the process of correcting the amount of conveyance.

As described above, in the sheet conveying operation, the error in the amount of conveyance varies at the time when the sheet is passed from the conveying roller 36 to the ejection roller 40 in accordance with the rotational phases of the conveying roller 36 and the ejection roller 40 at the time when the sheet is passed from the conveying roller 36 to the ejection roller 40. Therefore, in the process of correcting the amount of conveyance at the time when the sheet is passed from the conveying roller 36 to the ejection roller 40, it is important not only to correct the error in the amount of conveyance due to the eccentricity in sections A and C but also to correct the amount of conveyance such that the unit amount of conveyance (conveying speed) in section A and that in section C are set as close to each other as possible. In the state in which the sheet is conveyed by both the conveying roller 36 and the ejection roller 40 (section A), the role of the conveying roller 36 is dominant in the process of controlling the amount of conveyance. Therefore, in this state, it can be considered that the sheet is conveyed by the conveying roller 36.

The error in the amount of conveyance of the recording medium (sheet) P caused by the difference in the conveying speed between the conveying roller 36 and the ejection roller 40 when the recording medium P is passed between the rollers will be described below with reference to FIGS. 12 to 14C.

Figure 12:
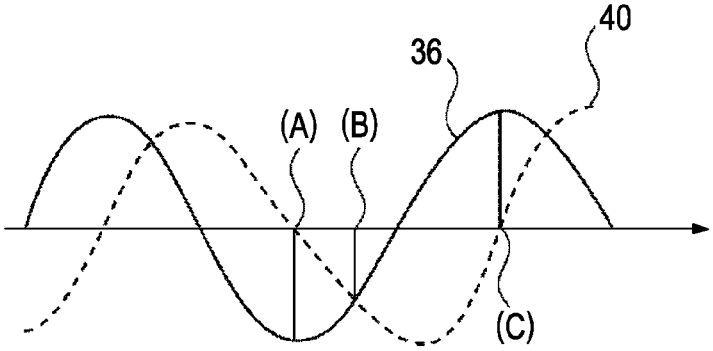
FIG. 12 is a diagram illustrating the error in the amount of conveyance for each rotational phase of the conveying roller and the ejection roller according to the embodiment.

In FIG. 12, the vertical axis shows the error in the amount of conveyance and the horizontal axis shows the rotational phase of the rollers. In FIG. 12, the solid line shows the variation in the amount of conveyance with respect to the rotational phase in the state in which the recording medium P is being conveyed by both the conveying roller 36 and the ejection roller 40 (section A). In addition, the dashed line shows the variation in the amount of conveyance with respect to the rotational phase in the state in which the recording medium P is being conveyed only by the ejection roller 40 (section C). In FIG. 12, the area above the horizontal axis at the center 0 of the vertical axis corresponds to the state in which the conveying speed is higher than a predetermined speed and the recording medium P is conveyed by an amount larger than a predetermined amount of conveyance. In this state, the sign of the error in the amount of conveyance is positive. In contrast, the area below the horizontal axis at the center 0 of the vertical axis corresponds to the state in which the conveying speed is lower than the predetermined speed and the recording medium P is conveyed by an amount smaller than the predetermined amount of conveyance. In this state, the sign of the error in the amount of conveyance is negative.

Figure 13A:
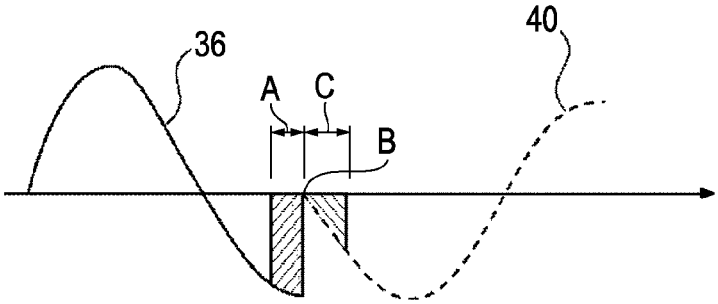
FIGS. 13A to 13C are diagrams illustrating the error in the amount of conveyance in sections A and C in the case where the sheet is passed between the rollers at rotational phases shown in FIG. 12.
Figure 13B:
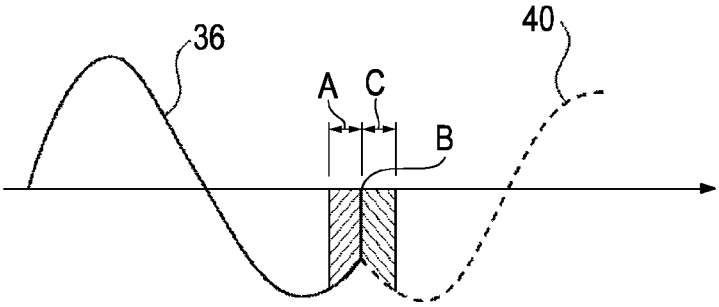
Figure 13C:
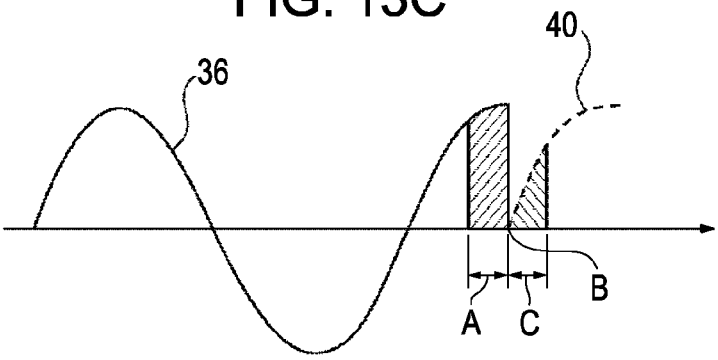
Figure 14A:
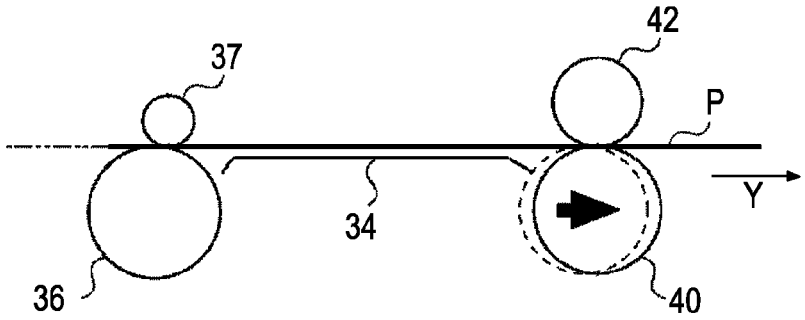
FIGS. 14A to 14C are diagrams illustrating the movement of the ejection roller in the states shown in FIGS. 13A to 13C, respectively.
Figure 14B:
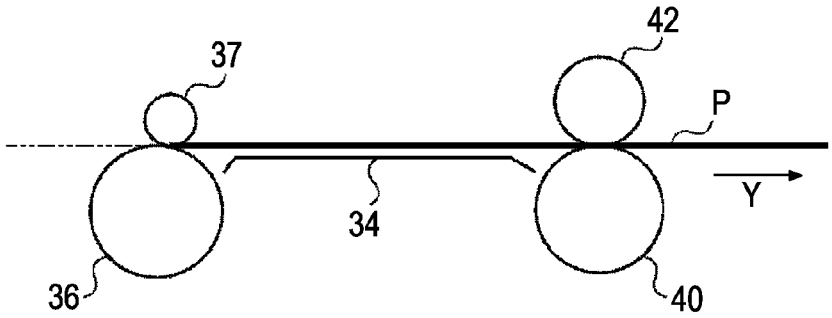
Figure 14C:
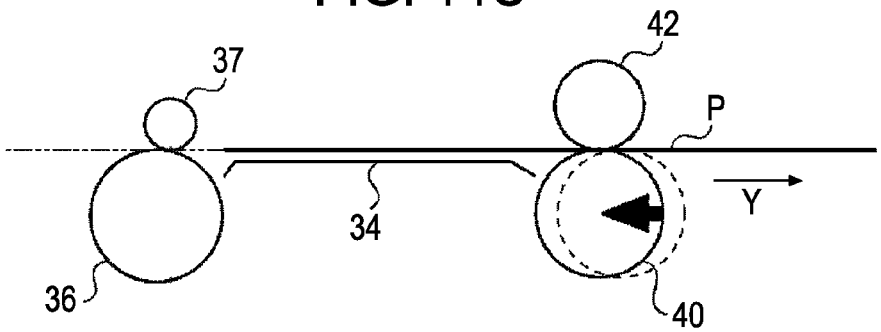

FIGS. 13A, 13B, and 13C are diagrams illustrating the errors in the amount of conveyance in sections A and C in the cases where the sheet is passed from the conveying roller 36 to the ejection roller 40 at rotational phases A, B, and C, respectively, shown in FIG. 12. FIGS. 14A to 14C are diagrams illustrating the movement of the ejection roller 40 corresponding to FIGS. 13A to 13C, respectively.

FIG. 13A illustrates the error in the amount of conveyance in sections A and C in the case where the sheet is passed at the rotational phase A shown in FIG. 12. At this phase, the error in the amount of conveyance caused by the conveying roller 36 is smaller than that caused by the ejection roller 40. In other words, the conveying speed of the conveying roller 36 is lower than that of the ejection roller 40. Therefore, the ejection roller 40 functions as a speed-increasing system with respect to the conveying roller 36. Accordingly, as shown in FIG. 14A, at the time when the trailing end of the recording medium P leaves the nip section of the conveying roller 36, the ejection roller 40 is instantaneously released from the state in which the ejection roller 40 is bent toward the upstream side due to a traction force (frictional force) between the ejection roller 40 and the recording medium P. Therefore, the ejection roller 40 moves downstream. As a result, at the time when the recording medium P is passed to the ejection roller 40, the amount of conveyance of the sheet is increased in accordance with the movement of the ejection roller 40. The error in the amount of conveyance at the time when the recording medium P is passed between the rollers corresponds to the sum of the above-described increase in the amount of conveyance, the integrated error in the amount of conveyance in section A shown in FIG. 13A, and the integrated error in the amount of conveyance in section C shown in FIG. 13A.

FIG. 13B illustrates the error in the amount of conveyance in sections A and C in the case where the sheet is passed at the rotational phase B shown in FIG. 12. At this phase, the error in the amount of conveyance caused by the conveying roller 36 is equal to that caused by the ejection roller 40. In other words, the conveying speed of the conveying roller 36 is equal to that of the ejection roller 40. Therefore, the ejection roller 40 functions as a speed-maintaining system. As shown in FIG. 14B, no force is applied to the ejection roller 40 from the recording medium P due to the speed difference between the conveying roller 36 and the ejection roller 40. Therefore, even when the recording medium P leaves the nip section of the conveying roller 36, the movement of the ejection roller 40 due to the release from the bent state does not occur. As a result, variation in the amount of conveyance of the recording medium P due to the movement of the ejection roller 40 does not occur. Therefore, the error in the amount of conveyance at the time when the recording medium P is passed between the rollers corresponds to the sum of the integrated error in the amount of conveyance in section A shown in FIG. 13B and the integrated error in the amount of conveyance in section C shown in FIG. 13B.

FIG. 13C illustrates the error in the amount of conveyance in sections A and C in the case where the sheet is passed at the rotational phase C shown in FIG. 12. At this phase, the error in the amount of conveyance caused by the conveying roller 36 is larger than that caused by the ejection roller 40. In other words, the conveying speed of the conveying roller 36 is higher than that of the ejection roller 40. Therefore, the ejection roller 40 functions as a speed-reducing system with respect to the conveying roller 36. Accordingly, as shown in FIG. 14C, at the time when the trailing end of the recording medium P leaves the nip section of the conveying roller 36, the ejection roller 40 is instantaneously released from the state in which the ejection roller 40 is bent toward the downstream side due to a traction force (frictional force) between the ejection roller 40 and the recording medium P. Therefore, the ejection roller 40 moves upstream. As a result, at the time when the recording medium P is passed to the ejection roller 40, the amount of conveyance of the sheet is reduced in accordance with the movement of the ejection roller 40. The error in the amount of conveyance at the time when the recording medium P is passed between the rollers corresponds to the sum of the above-described reduction in the amount of conveyance, the integrated error in the amount of conveyance in section A shown in FIG. 13C, and the integrated error in the amount of conveyance in section C shown in FIG. 13C.

According to the present embodiment, a first conveyance-amount control process and a second conveyance-amount control process can be performed as a conveyance-amount control for correcting the error in the amount of conveyance at the time when the recording medium is passed between the rollers. The first conveyance-amount control process and the second conveyance-amount control process will now be described.

First Conveyance-Amount Control

First, a first conveyance-amount control process, which is one of control methods for correcting the amount of conveyance in the sheet-conveying operation at the time when the sheet is passed between the rollers, will be described. In a basic procedure of a control method for correcting the amount of conveyance in the sheet-conveying operation at the time when the sheet is passed between the rollers, first, the sheet is conveyed while the rotational phases of the rollers are managed and the amount of conveyance of the sheet is measured for each of the rotational phase ranges in each of sections A and C. Then, the correction value for the amount of conveyance is calculated for each rotational phase range in each of section A (conveying roller) and section C (ejection roller) on the basis of the measurement result. Then, in the actual recording operation, the conveyance-amount correction value for correcting the amount of conveyance in the sheet-conveying operation at the time when the sheet is passed between the rollers is calculated on the basis of the conveyance-amount correction values for the conveying roller and the ejection roller for each rotational phase range.

Figure 22:
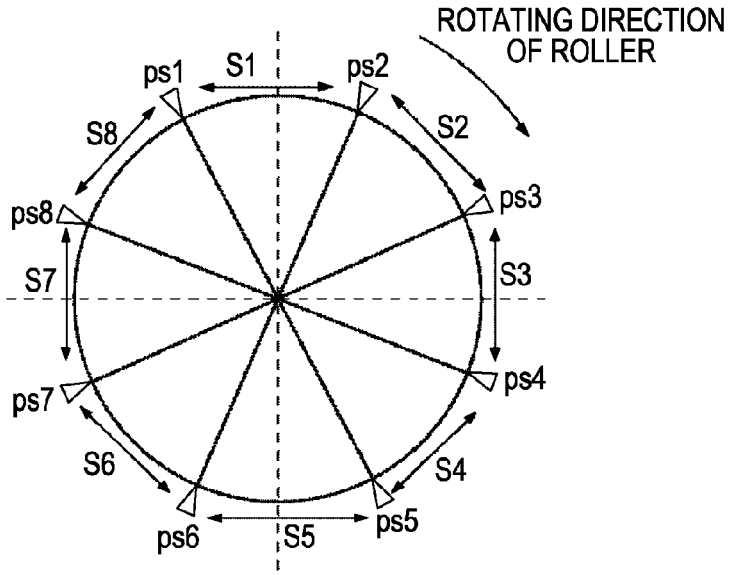
FIG. 22 is a diagram illustrating a correction value table which lists correction values for each of rotational phase ranges of the conveying roller and the ejection roller.

FIG. 22 is a diagram illustrating eight rotational phase ranges S1 to S8 defined by evenly dividing the circumference of a roller into eight sections and a correction value table which lists the conveyance-amount correction values set for each of the rotational phase ranges. In FIG. 22, positions ps1 to ps8 correspond to the rotational phases of the roller at which the conveyance of the sheet is started in a single conveying operation. In this example, the circumference of each of the conveying roller 36 and the ejection roller 40 is divided into eight sections, and the conveyance-amount control is individually performed for each of the eight rotational phase ranges S1 to S8. The rotational speed ratio between the conveying roller 36 and the ejection roller 40 is 1:1. Therefore, the rotational phases of the conveying roller 36 and the ejection roller 40 are adjusted to the same angle.

Figure 18:
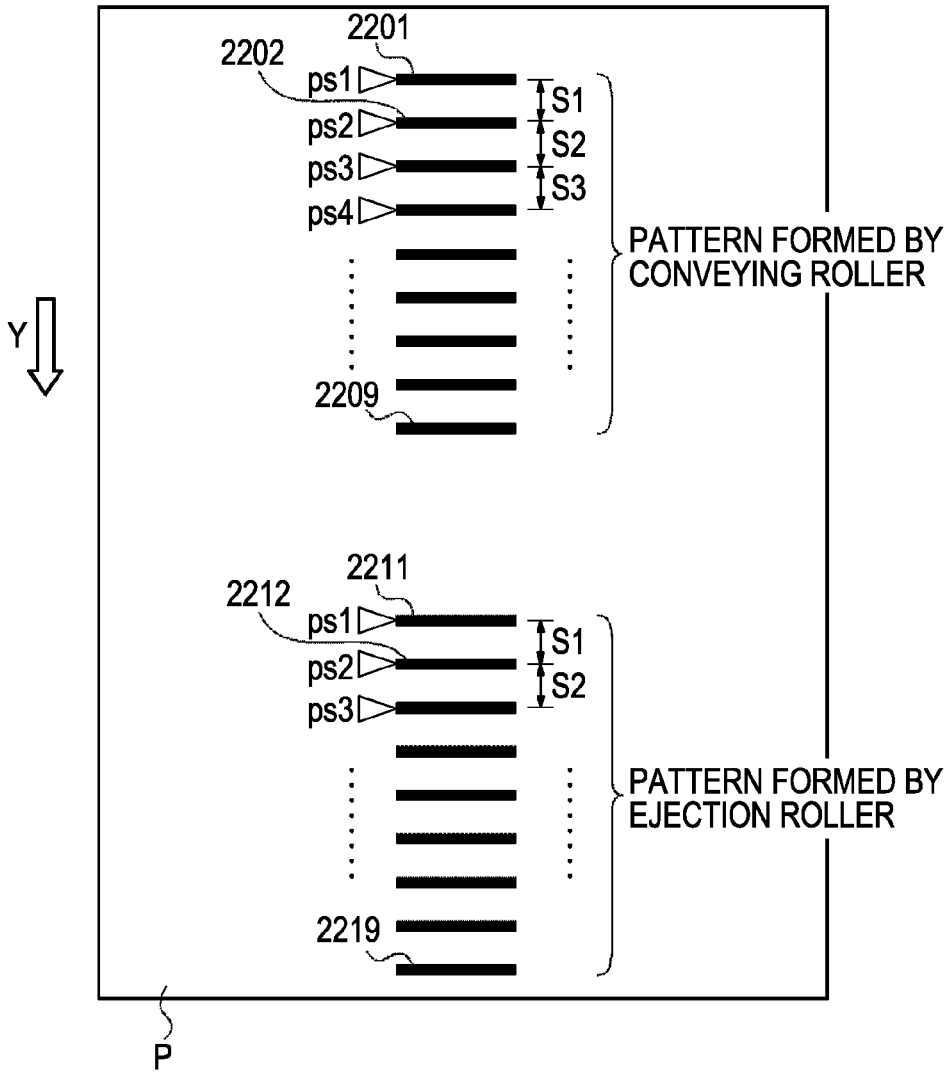
FIG. 18 is a diagram illustrating a test pattern used to obtain the correction values for each of the rotational phase ranges of the conveying roller and the ejection roller according to the embodiment.

FIG. 18 illustrates an example of a test pattern recorded to obtain the conveyance-amount correction values for the conveying roller 36 and the ejection roller 40 for each of the rotational phase ranges.

A method for obtaining the conveyance-amount correction values for the conveying roller 36 and the ejection roller 40 for each of the rotational phase ranges will be described with reference to FIGS. 22 and 18.

First, a detection process for detecting the above-described origin of the rotational phase of each roller is performed to determine the origin of the rotational phase of each roller, so that the rotational phase of each roller can be managed. Then, in the state in which the rotational phase of each roller can be managed, the test pattern shown in FIG. 18 is recorded.

In the process of recording the test pattern, first, an operation of feeding a sheet is performed by the sheet feeding section and the sheet is conveyed until the rotational phase of the conveying roller 36 reaches position ps1. After the rotational phase of the conveying roller 36 reaches position ps1, a first test pattern element 2201 is recorded. After the first test pattern element 2201 is recorded, the sheet conveying operation is restarted from the state in which the rotational phase of the conveying roller 36 is at position ps1, and the sheet is conveyed until the rotational phase of the conveying roller 36 reaches position ps2. Then, a second test pattern element 2202 is recorded. The distance between the first test pattern element 2201 and the second test pattern element 2202 corresponds to the unit amount of conveyance corresponding to the rotational phase range s1 between positions ps1 and ps2. After the second test pattern element 2202 is recorded, the sheet conveying operation is restarted from the state in which the rotational phase of the conveying roller 36 is at position ps2, and the sheet is conveyed until the rotational phase of the conveying roller 36 reaches position ps1. Then, a third test pattern element 2203 is recorded.

The above-described steps are repeated until the rotational phase of the conveying roller 36 returns to position ps1. As a result, nine test pattern elements 2201 to 2209 are recorded.

Next, to record test pattern elements while the sheet is conveyed only by the ejection roller 40, the sheet is conveyed until the trailing end of the sheet leaves the nip section of the conveying roller 36 and the rotational phase of the ejection roller 40 reaches position ps1. After the rotational phase of the ejection roller 40 reaches position ps1, a first test pattern element 2211 is recorded. Then, the sheet conveying operation is restarted from the state in which the rotational phase of the ejection roller 40 is at position ps1, and the sheet is conveyed until the rotational phase of the ejection roller 40 reaches position ps2. Then, a second test pattern element 2212 is recorded. The above-described steps are repeated until the rotational phase of the ejection roller 40 returns to position ps1. As a result, nine test pattern elements 2211 to 2219 are recorded.

After the test pattern is recorded, distances between the test pattern elements 2201 to 2209 and 2211 to 2219 are measured by, for example, a scanner (optical sensor) or the like which is provided on the carriage 50.

The distances between the test pattern elements 2201 to 2209 correspond to the amounts of conveyance corresponding to the rotational phase ranges S1 to S8 of the conveying roller 36. The distances between the test pattern elements 2211 to 2219 correspond to the amounts of conveyance corresponding to the rotational phase ranges S1 to S8 of the ejection roller 40. Therefore, the error in the amount of conveyance for each of the rotational phase ranges S1 to S8 of the conveying roller 36 can be determined by measuring the distances between the test pattern elements 2201 to 2209. Similarly, the error in the amount of conveyance for each of the rotational phase ranges S1 to S8 of the ejection roller 40 can be determined by measuring the distances between the test pattern elements 2219 to 2211.

Then, the conveyance-amount correction values are stored at correction value storage areas prepared for the respective rotational phase ranges of each roller. More specifically, the correction values are determined by subtracting the measured amounts of conveyance from the desired amounts of conveyance and are stored in cells SLF1 to SLF8 and SEJ1 to SEJ8 in the correction value table shown in FIG. 22.

Due to the above-described procedure, the conveyance-amount correction values for the respective rotational phase ranges are obtained for each of the conveying roller 36 and the ejection roller 40.

Next, a method for calculating the conveyance-amount correction value for when the sheet is passed between the rollers on the basis of the correction values for the respective rotational phase ranges of each roller will be described. As described above, to correct the amount of conveyance at the time when the sheet is passed from the conveying roller 36 to the ejection roller 40, it is necessary to consider not only the errors in the amount of conveyance in sections A and C but also the influence of bending caused by the difference in the conveying speed between the rollers. As described above, the conveying speed of each roller varies depending on the error in the unit amount of conveyance of the roller. Accordingly, the correction value for when the sheet is passed between the rollers is calculated as in Equation (1) by using coefficients A and B which are calculated on the basis of a difference between the conveyance-amount correction values for the respective rollers.

$$Sh=A\cdot SLF+B\cdot SEJ \quad (1)$$

Sh: conveyance-amount correction value in the sheet-conveying operation at the time when the sheet is passed between the rollers SLF: conveyance-amount correction value of conveying roller 36 (first correction value)

SEJ: conveyance-amount correction value of ejection roller 40 (second correction value)

Figure 15:
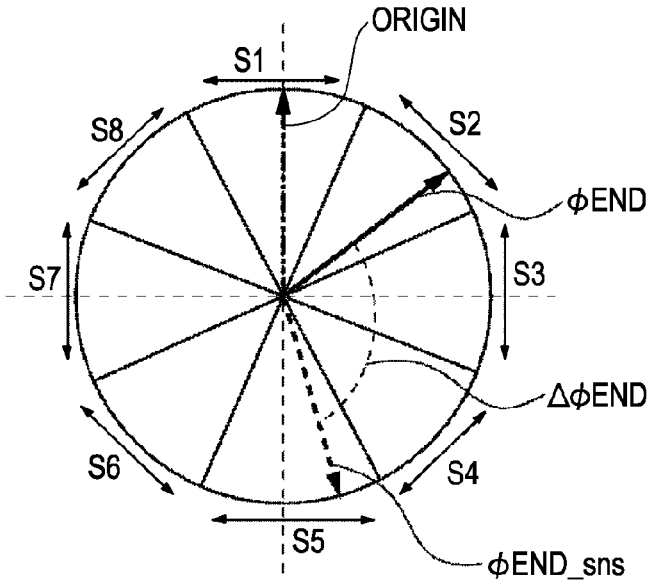
FIG. 15 is a diagram illustrating a correction value table which lists correction values for each of rotational phase ranges according to the embodiment.

According to Equation (1), the correction values Sh1 to Sh8 for when the sheet is passed between the rollers are calculated by considering not only the errors in the amount of conveyance caused in section A (conveying roller) and section C (ejection roller) but also a specific error in the amount of conveyance caused by the difference in the conveying speed between the rollers. The thus-calculated correction values Sh1 to Sh8 for when the sheet is passed between the rollers are stored in association with the rotational phase ranges in the correction value table shown in FIG. 15.

Since each of the conveying roller 36 and the ejection roller 40 has a correction value for each of the eight rotational phase ranges, the maximum number of conveyance-amount correction values for when the sheet is passed between the rollers is 64. However, in the present control process, the rotational speed ratio between the conveying roller 36 and the ejection roller 40 is 1:1, and therefore the eight correction values for the conveying roller 36 and the eight correction values for the ejection roller 40 are in one-to-one correspondence. Therefore, the number of conveyance-amount correction values for when the sheet is passed between the rollers is 8.

Figure 16A:
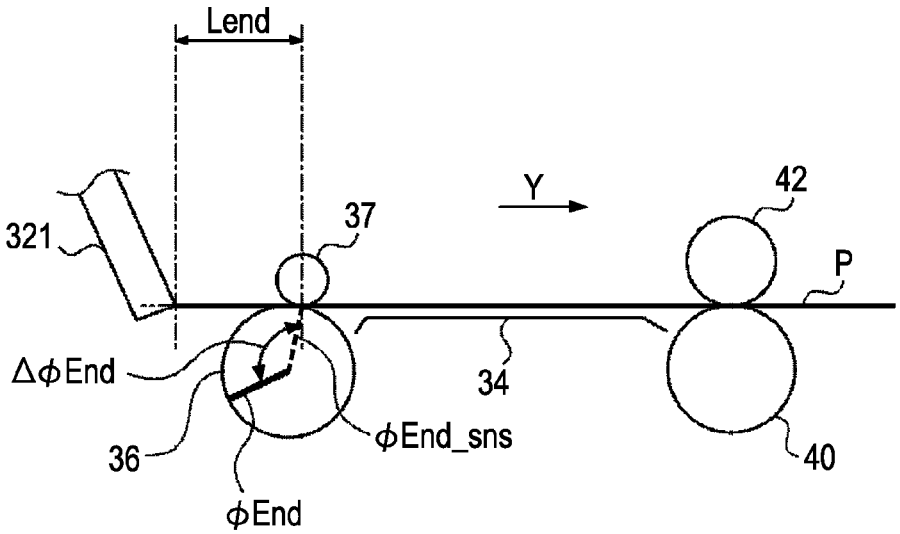
FIGS. 16A and 16B are diagrams illustrating a method for obtaining rotational phases of the rollers in a conveying operation in which the sheet is passed between the rollers.
Figure 16B:
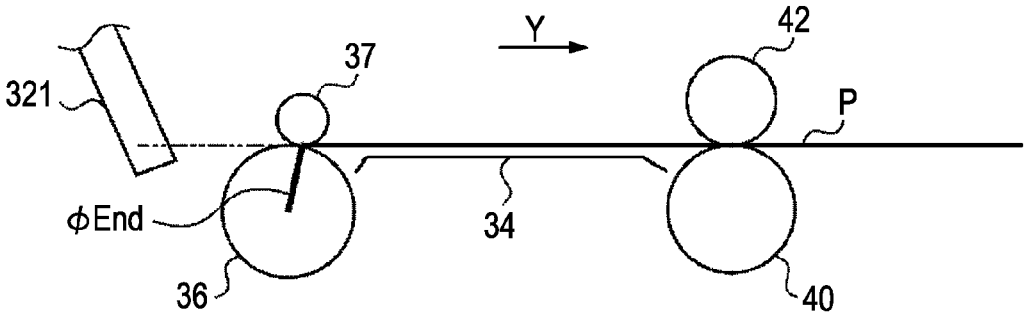

Next, the conveyance-amount control process for when the sheet is passed between the rollers in the actual recording operation will be described with reference to FIGS. 16A, 16B, and 17. FIGS. 16A and 16B are diagrams illustrating a method for obtaining the rotational phase of the rollers at the time when the sheet is passed between the rollers in the sheet conveying operation. FIG. 16A shows the state at the time when the trailing end of the sheet is detected by a lever 321 which is located at a position upstream of the recording head 7 in the conveying direction. At this time, the rotational phase of the rollers is ϕEnd_sns. FIG. 16*b* shows the state at the time when the trailing end of the sheet leaves the nip section of the conveying roller 36. At this time, the rotational phase of the rollers is ϕEnd.

Figure 17:
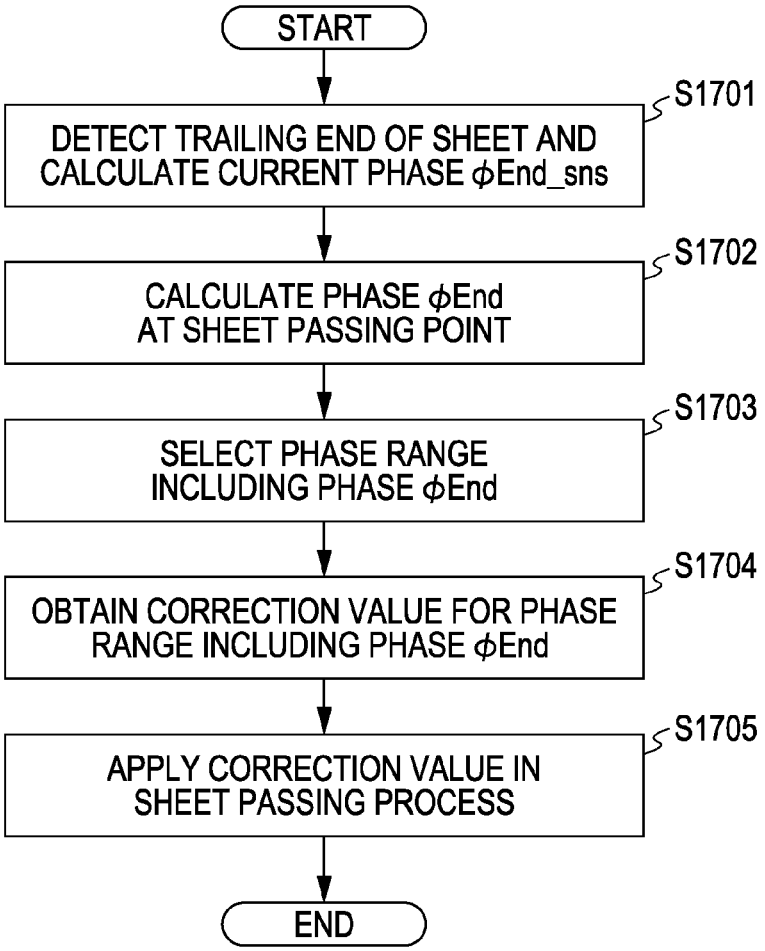
FIG. 17 is a flowchart of a control process for correcting the amount of conveyance by a first conveyance-amount control process at the time when the sheet is passed between the rollers in a recording operation.

FIG. 17 is a flowchart of a control process for correcting the amount of conveyance at the time when the sheet is passed between the rollers in the actual recording operation.

Referring to FIG. 17, after the actual recording operation is started, the trailing end of the sheet is detected and the rotational phase ϕEnd_sns of the rollers at this time is determined in step S1701. Then, the rotational phase ϕEnd_sns of the rollers is determined. As shown in FIG. 16A, at this time, the trailing end of the sheet is spaced from the position at which the sheet is passed between the rollers (switching point between sections A and C) by a distance Lend. The distance Lend corresponds to a rotation angle range ΔϕEnd.

In step S1701, a known method for detecting the trailing end of the sheet may be used. For example, the lever 321 (see FIGS. 16A and 16B) may be structured such that the lever 321 moves away from a standby position when the lever 321 comes into contact with the leading end of the sheet being conveyed and returns to the standby position when the trailing end of the sheet passes the lever 321. The trailing end of the sheet can be detected by detecting the return of the lever 321 to the standby position.

Next, in step S1702, a rotational phase ϕEnd at the time when the sheet is passed between the rollers is calculated on the basis of the rotational phase ϕEnd_sns and the distance Lend at the time of detection of the trailing end of the sheet.

In step S1703, the rotational phase range to which the rotational phase ϕEnd calculated in step S1702 belongs is determined. Here, it is assumed that the rotational phase ϕEnd at the time when the sheet is passed belongs to the rotational phase range S2.

Next, in step S1704, the conveyance-amount correction value corresponding to the rotational phase range determined in step S1703 is obtained. In this example, the conveyance-amount correction value Sh2 corresponding to the rotational phase range S2 is obtained. At the time when the sheet is passed between the rollers in the actual image recording operation, the amount of conveyance is corrected using the correction value obtained by the above-described process (step S1705).

In the above-described process, the rotational phase range corresponding to the time when the sheet is passed between the rollers is determined on the basis of the rotational phase ϕEnd at the time when the trailing end of the sheet is detected. However, the calculation may also be performed on the basis of the phase origin ϕOrign. In addition, instead of using the detection information of the trailing end of the sheet, the correction value may be obtained by estimating the rotational phase at the time when the sheet is passed between the rollers on the basis of information representing the length of the recording medium and information representing a print start position.

In addition, in the above-described process, the conveyance-amount correction value for when the sheet is passed between the rollers is calculated in advance on the basis of the conveyance-amount correction values for the conveying roller and the ejection roller for each of the rotational phase ranges. In the actual recoding operation, a suitable correction value is selected from the correction value table in which the calculated correction values are stored. However, calculation of the correction values may also be performed such that only the conveyance-amount correction values for the conveying roller and the ejection roller for each of the rotational phase ranges are obtained in advance and the conveyance-amount correction value for when the sheet is passed between the rollers is calculated in the actual recording operation.

The amount of conveyance at the time when the sheet is passed from the conveying roller to the ejection roller varies in accordance with the errors in the amount of conveyance in sections A and C caused by the eccentricity of the rollers and the error in the amount of conveyance caused by the difference in the conveying speed between the rollers. The above-mentioned two kinds of errors in the amount of conveyance are both largely influence by the unit amount of conveyance (conveying speed) in section A (conveying roller) and that in section C (ejection roller). Therefore, in the operation of correcting the amount of conveyance at the time when the sheet is passed between the rollers, it is necessary to correct the amount of conveyance on the basis of the relationship between the unit amount of conveyance (conveying speed) in section A (conveying roller) and that in section C (ejection roller).

According to the first conveyance-amount control process, the amount of conveyance for when the sheet is passed between the rollers is corrected on the basis of the difference in the unit amount of conveyance (conveying speed) between the conveying roller and the ejection roller. Therefore, compared to the known method in which the fixed correction value is applied, the sheet can be conveyed with a higher accuracy.

Second Conveyance-Amount Control

In the first conveyance-amount control process, the conveyance-amount correction value for when the sheet is passed between the rollers is determined in advance for each of the rotational phase ranges of the rollers. Accordingly, the conveyance control process can accurately performed with a small error in the amount of conveyance irrespective of the rotational phase range in which the sheet is passed between the rollers in the sheet conveying operation. In contrast, in the second conveyance-amount control process, the conveyance-amount correction value for when the sheet is passed between the rollers is determined for each of the rotational phase ranges of the rollers, and then an optimum rotational phase range for when the sheet is passed between the rollers in the sheet conveying operation is determined. In the actual recording operation, the sheet conveying operation is controlled such that the sheet is passed between the rollers in the optimum rotational phase range.

In the second conveyance-amount control process, the sheet conveying operation is controlled such that the sheet is passed between the rollers in the rotational phase range in which the conveying speed of the conveying roller 36 and the conveying speed of the ejection roller 40 are equal to each other (or closest to each other) at the time when the trailing end of the sheet leaves the nip section of the conveying roller 36. In the recording apparatus in which the bearings of each roller are disposed symmetrical to each other in the left-right direction about the center of the sheet in the width direction thereof, the center of the sheet coincides with the center of each roller. Therefore, optimally, the conveying roller 36 and the ejection roller 40 have the same amount of conveyance (conveying speed).

First, a method for controlling the sheet conveying operation such that the sheet can be passed between the rollers at the desired rotational phase will be described.

When the sheet is fed from the sheet feeding unit and the leading end of the sheet reaches the conveying roller 36, the leading end of the sheet is nipped by the conveying roller 36. After this, the sheet conveying operation is performed while substantially no slip occurs between the sheet and the conveying roller 36. Therefore, after the leading end of the sheet reaches the conveying roller 36, the position of the sheet and the rotational phase of the conveying roller 36 can be uniquely managed, and the rotational phase at the time when the sheet will be passed between the rollers can be easily estimated. Accordingly, the rotational phase at the time when the sheet is passed between the rollers (point B) can be controlled by adjusting the rotational phase of the conveying roller 36 at the time when the leading end of the sheet reaches the nip section of the conveying roller 36 on the basis of the length of the sheet.

Figure 19A:
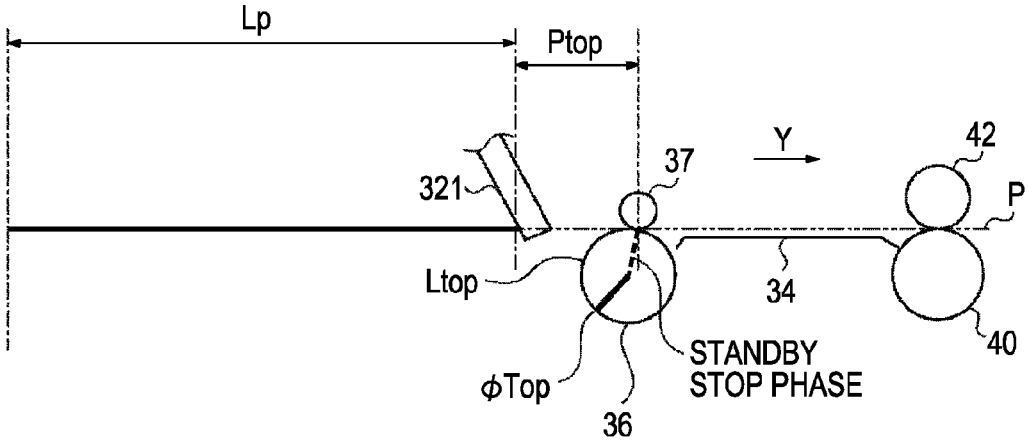
FIGS. 19A and 19B are diagrams illustrating the manner in which the sheet is conveyed from when a leading end of the sheet is detected to when the leading end of the sheet is nipped by a nip section of the conveying roller.
Figure 19B:
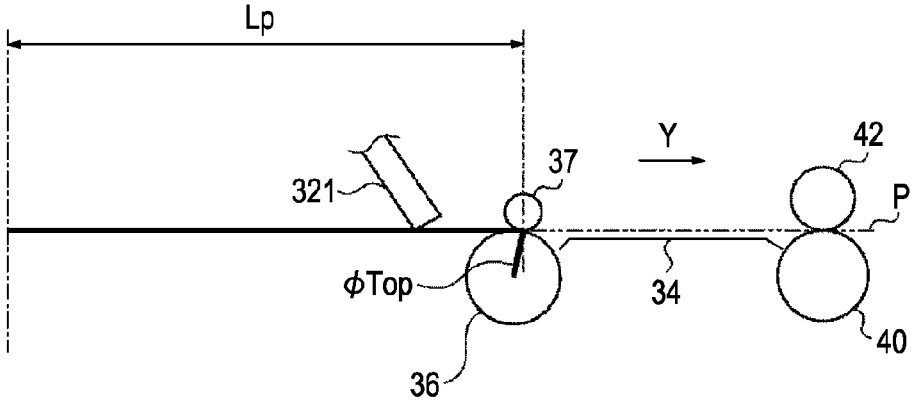
Figure 20:
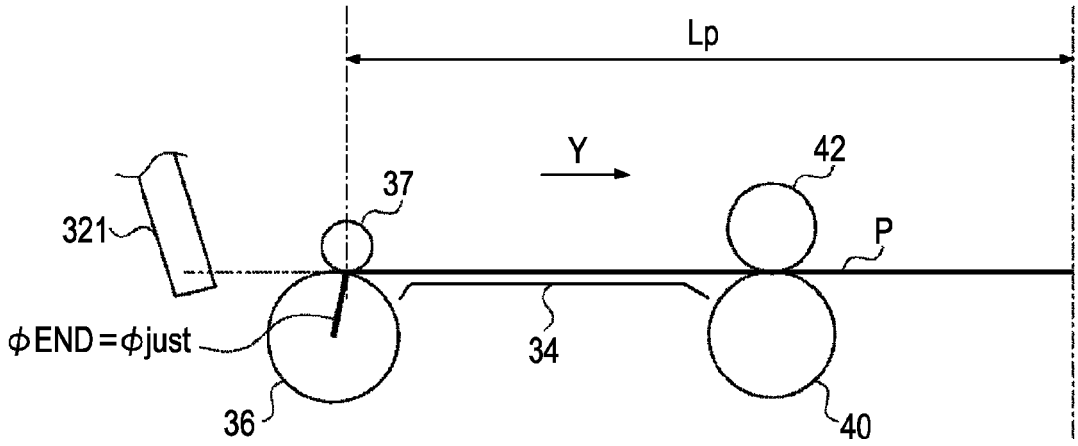
FIG. 20 is a diagram illustrating the manner in which a trailing end of the sheet leaves the nip section of the conveying roller at an optimum rotational phase $\phi$just.

Next, a method for controlling the sheet conveying operation in the second conveyance-amount control process at the time when the sheet is passed between the rollers will be described with reference to FIGS. 19A, 19B, 20, and 21. FIGS. 19A and 19B are diagrams illustrating the manner in which the sheet is conveyed from when the leading end of the sheet is detected to when the leading end of the sheet is nipped by the nip section of the conveying roller 36. FIG. 19A shows the state at the time when the leading end of the sheet is detected by the lever 321, and FIG. 19B shows the state at the time when the leading end of the sheet is nipped by the nip section of the conveying roller 36. FIG. 20 is a diagram illustrating the manner in which the trailing end of the sheet leaves the nip section of the conveying roller 36 at an optimum rotational phase $\phi$just.

Figure 21:
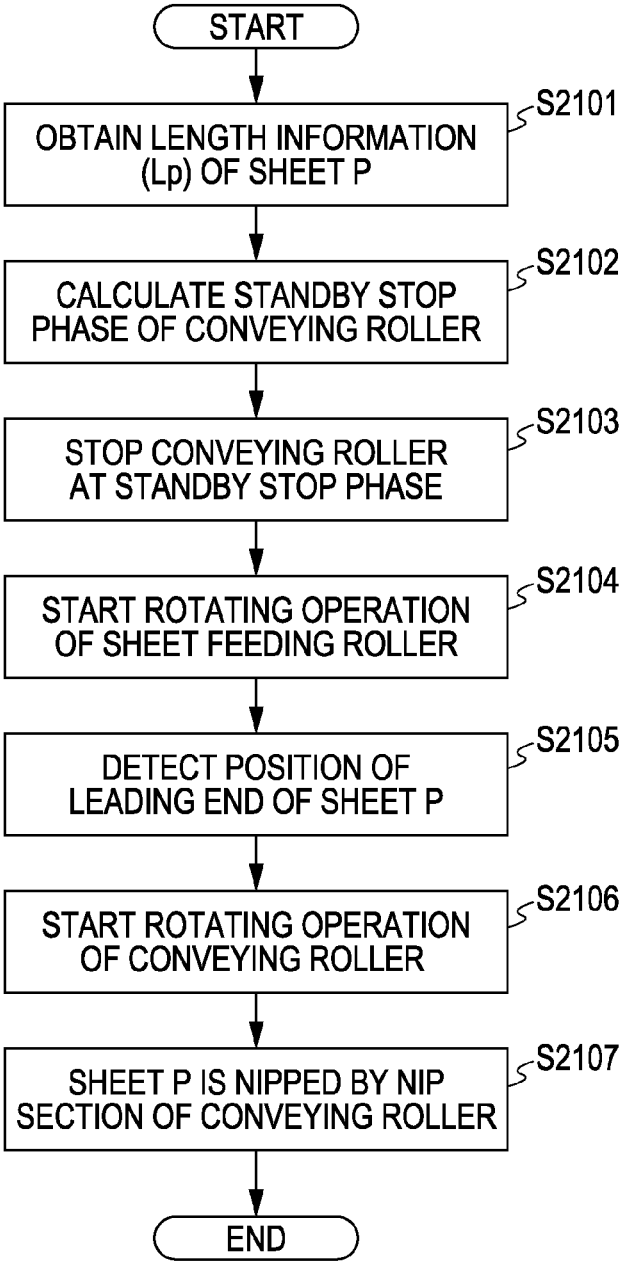
FIG. 21 is a flowchart of a control process for correcting the amount of conveyance by a second conveyance-amount control process at the time when the sheet is passed between the rollers in a recording operation.

FIG. 21 is a flowchart of the conveyance control process for when the sheet is passed between the rollers in the conveyance-amount control process according to the present example.

Referring to FIG. 21, in step S2101, the length information Lp representing the length of the sheet is obtained from a printer driver or an input device. The length information of the sheet can also be obtained by using a sensor disposed in the recording apparatus.

Next, in step S2102, an initial phase (standby stop phase) at which the rotation of the conveying roller 36 is to be started is calculated on the basis of the above-described length information Lp of the sheet.

Next, in step S2103, the conveying roller 36 is stopped at the standby stop phase, and then the sheet feed roller 28 is rotated to start the sheet feeding operation (step S2104). Next, in step S2105, the sheet comes into contact with the lever 321 and rotates the lever 321. Thus, a length Ptop from the leading-end of the sheet is detected by a leading-edge detection sensor. When the sheet is further conveyed by the sheet feed roller 28 by the distance Ptop from the position at which the leading end of the sheet is detected, the leading end of the sheet reaches the nip section of the conveying roller 36. The conveying roller 36 starts to rotate (S2106) at the time when the leading end of the sheet is detected. The rotation of the conveying roller 36 is controlled such that the conveying speed thereof is equal to the conveying speed of the sheet feed roller 28 until the sheet P reaches the nip section of the conveying roller 36. Then, the sheet P is nipped by the nip section of the conveying roller 36 in S2107. In the second conveyance-amount control process, the rotational phase at the time when the sheet will be passed between the rollers is determined at this time. Therefore, by performing the above-described control operation, the rotational phase of the rollers at the time when the sheet will be passed between the rollers can be set to the optimum rotational phase ϕjust.

A method for calculating the initial phase (standby stop phase) for controlling the sheet conveying operation such that sheet can be passed between the rollers at the optimum phase ϕjust will now be described with reference to FIGS. 19A and 19B.

The amount of conveyance obtained by the sheet feed roller 28 in an interval from when the leading end of the sheet P is detected to when the sheet P is nipped by the nip section of the conveying roller 36 is Ptop, whereas the amount of conveyance of the conveying roller 36 in this interval is Ltop, which is smaller than Ptop. This is because the conveying roller 36 starts to rotate from the stationary state, whereas the sheet feed roller 28 is continuously rotated. The amount of conveyance Ltop can be uniquely determined when the rotational speed of the sheet feed roller 28 and the rotational speed of the conveying roller 36 are determined in accordance with the recording mode. Thus, the conveying roller 36 is stopped at the rotational phase which is in front of the rotational phase at which the sheet P is to be nipped by the nip section by an amount corresponding to the amount of conveyance Ltop.

When the conveying roller 36 is rotated by an amount corresponding to the length Lp of the sheet P after the sheet P reaches the conveying roller 36, the sheet P is passed from the conveying roller 36 to the ejection roller 40 (see FIG. 20). The phase of the conveying roller 36 can be controlled in advance so that the rotational phase of the conveying roller 36 is equal to the optimum rotational phase at this time.

Assuming that the optimum phase of the conveying roller 36 for when the sheet is passed between the rollers is ϕjust, the sheet P can be passed between the rollers at the time when the rotational phase of the conveying roller 36 is ϕjust if the sheet P reaches the conveying roller 36 at a phase that is in front of ϕjust by an amount corresponding to a phase difference calculated as (Lp)/(πDr). Here, Dr is the conveyance diameter of the conveying roller 36. Accordingly, the standby stop phase of the conveying roller 36 can be set to the phase in front of the optimum phase ϕjust by an amount corresponding to a phase difference calculated as (Lp+Ltop)/(πDr). The standby stop phase of the conveying roller 36 can also be set in consideration of the amount of slip of the conveying roller 36. In such a case, the conveyance control process can be more accurately performed.

Due to the above-described operation, the sheet can be passed between the rollers at the optimum phase ϕjust in the sheet conveying operation, and the sheet conveying operation can be performed with high stability and accuracy. Although there is a possibility that unexpected errors in the amount of conveyance will occur due to manufacturing errors of the recording apparatus, aging, the type of paper, etc., and the sheet cannot be passed between the rollers at the optimum phase ϕjust in the sheet conveying operation, the possibility is extremely low. In the case where the sheet cannot be passed between the rollers at the optimum phase ϕjust in the sheet conveying operation, the error in the amount of conveyance can be reduced by applying the correction value corresponding to the rotational phase at the time when the sheet is passed between the rollers, as in the case where the first conveyance-amount control process is performed.

The optimum phase ϕjust differs depending on the axial lengths of the rollers and the setting of the rollers. As described above, in the case where the center of the sheet coincides with the center between the bearings at the ends of each roller, the optimum phase ϕjust is set to the rotational phase at which the conveying speed of the conveying roller 36 and the conveying speed of the ejection roller 40 are equal to each other (or closest to each other) at the time when the trailing end of the sheet leaves the nip section of the conveying roller 36.

In the case where the ejection roller 40 is provided with the ejection assist roller 41 which functions as a speed-increasing system and the center of the sheet does not coincide with the center between the bearings at the ends of each roller, the amount of conveyance does not become stable even when the difference in the conveying speed between the conveying roller 36 and the ejection roller 40 is reduced. This is because immediately after the sheet leaves the nip section, the ejection roller 40 moves downstream by being released from the bent state while being influenced by the difference between the left and right sections in the axial direction thereof. This becomes particularly significant when the ejection assist roller 41 functions as a speed increasing system for the ejection roller 40. In such a case, a phase at which the ejection roller 40 functions as a speed-reducing system with respect to the conveying roller 36 is selected on the basis of the relationship between the unit amount of conveyance of the conveying roller 36 and that of the ejection roller 40. Thus, the ejection roller 40 is bent toward the downstream side in advance. In such a case, the above-described influence of the release from the bent state can be canceled.

As described above, according to the second conveyance-amount control process, the sheet can be passed between the rollers with high accuracy in the sheet conveying operation by setting the optimum phase ϕjust for when the sheet is passed between the rollers in accordance with the structure of the recording apparatus.

Characteristics of Control Process of Present Embodiment

Comparison between the first conveyance-amount control process and the second conveyance-amount control process will now be discussed. In the first conveyance-amount control process, the rotational phase range in which the sheet is passed between the rollers in the sheet conveying operation is not determined. Therefore, there is a possibility that an unexpected error in the amount of conveyance will occur depending on the rotational phase range. In contrast, in the second conveyance-amount control process, the optimum rotational phase range for when the sheet is passed between the rollers in the sheet conveying operation is determined. Then, the sheet conveying operation is controlled such that the sheet is passed between the rollers in the optimum rotational phase range. Therefore, according to the second conveyance-amount control process, the unexpected error in the amount of conveyance can be more reliably suppressed and the conveyance control process can be performed with higher stability and accuracy compared to the first conveyance-amount control process.

However, in the second conveyance-amount control process, in order for the sheet to be passed between the rollers in the optimum rotational phase range in the sheet conveying operation, it is necessary to calculate the initial phase (standby stop phase) of the conveying roller and stop the conveying roller at the standby stop phase after rotating the conveying roller to the standby stop phase. Therefore, in the case where the second conveyance-amount control process is performed in the recording operation, a longer time is required to record an image compared to the case in which the first conveyance-amount control process is performed.

Accordingly, in the present embodiment, the first conveyance-amount control process and the second conveyance-amount control process are selectively performed in accordance with the recording quality set in the image recording operation. The relationship between the recording mode and the conveyance-amount control process according to the present embodiment will be described with reference to FIG. 23.

In the recording apparatus according to the present embodiment, three types of recording qualities, that is, "high speed", "normal", and "high quality" can be selected in the case where an image is recorded on normal paper. The three types of recording qualities correspond to different numbers of recording paths in a so-called multi-path recording method, which is a recording method in which a predetermined area (also called a band) on the recording medium is scanned multiple times. In the "high speed" mode, the number of paths is 1. Therefore, the image can be recorded at a high speed, although the recording quality is low. In the "high quality" mode, the number of paths is 4. Therefore, an image with a highest quality can be obtained, although a long recording time is required since the number of paths is large. In the "normal" mode, the number of paths is 2, so that a standard recording quality and a standard recording speed can be obtained. A user can arbitrarily select the recording quality by operating an operation unit provided on the recording apparatus or a host apparatus that is connected to the recording apparatus.

According to the present embodiment, when the "high speed" mode, in which the recording speed is prioritized over the recording quality, is selected, the first conveyance-amount control process is selected so that it is not necessary to stop the conveying roller at the standby stop phase. When the "normal" mode or the "high quality" mode is selected, the second conveyance-amount control process is performed in the recording operation. Therefore, the conveyance control process can be performed with high stability and accuracy and a high-quality image can be obtained. Due to the above-described operation, both the image recording operation in which the recording speed is prioritized and the image recording operation in which the conveyance control process is performed with high accuracy so that high quality images can be obtained can be achieved.

Figure 24:
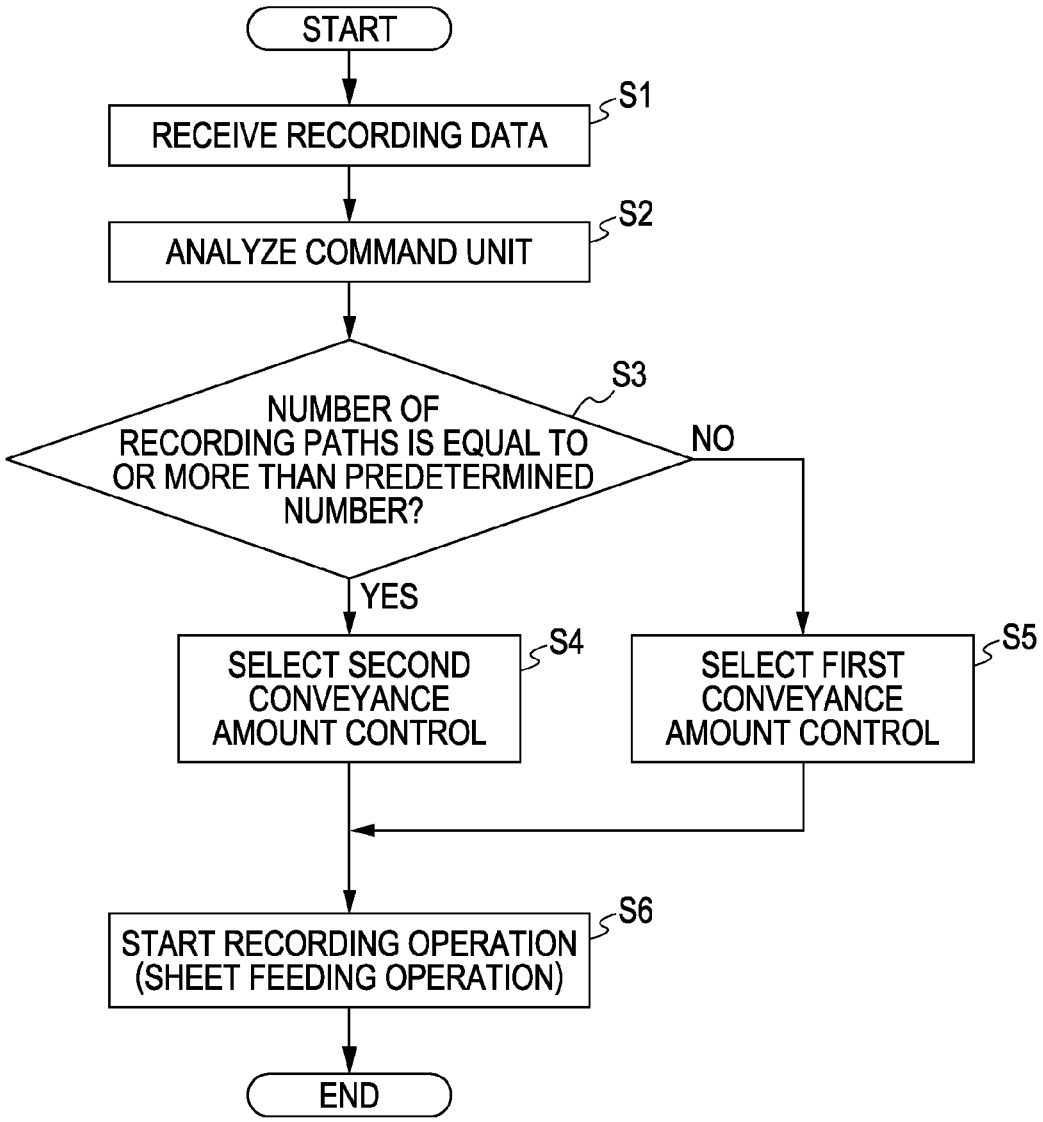
FIG. 24 is a flowchart of a process for selecting the conveyance-amount control process according to the first embodiment.

FIG. 24 is a flowchart of a process for selecting one of the first conveyance-amount control process and the second conveyance-amount control process according to the present embodiment.

First, recording data is received in step S1. Then, in step S2, a command unit attached to the recording data is analyzed. Information representing the type of paper on which an image is to be recorded and the selected recording quality can be obtained by analyzing the command unit in step S2.

Next, in step S3, it is determined whether or not the number of recording paths which corresponds to the selected recording quality is equal to or larger than a predetermined number of paths. In this example, the type of paper is normal paper. Therefore, it is determined whether or not the number of recording paths is 2 or more. Thus, it can be determined whether the recording quality is set to "high speed" for which the first conveyance-amount control process is to be selected or one of "normal" and "high quality" for which the second conveyance-amount control process is to be selected. If the number of recording paths is 2, which corresponds to "normal", or 4, which corresponds to "high quality", the process proceeds to step S4 and the second conveyance-amount control process is selected. If the number of recording paths is 1, which corresponds to "high speed", the process proceeds to step S5 and the first conveyance-amount control process is selected.

Then, in step S6, the first conveyance-amount control process selected in step S5 or the second conveyance-amount control process selected in step S4 is performed in the recording operation.

As described above, according to the present embodiment, the first conveyance-amount control process and the second conveyance-amount control process are selectively performed in accordance with the selected recording quality. Therefore, both the image recording operation in which the recording speed is prioritized and the image recording operation in which the conveyance control process is performed with high accuracy so that high quality images can be obtained can be achieved.

Second Embodiment

According to the second embodiment, the first conveyance-amount control process and the second conveyance-amount control process are selectively performed depending on whether or not a decimation process is performed at a band boundary area.

A band decimation process will now be described in detail.

In the case where, for example, an image is recorded on normal paper in a single-path recording mode in which the recording speed can be effectively increased, there is a risk that black lines which degrade the recording quality will be formed. This occurs because ink flows from one band to another band in a boundary area (also called a connecting area) between the adjacent bands, in particular, in an area where the recording duty is high. More specifically, the density is increased at the boundary area between the adjacent bands and the black lines are easily formed in the boundary area. This leads to the above-mentioned degradation of the image quality.

To solve this problem, Japanese Patent Laid-Open No. 11-188898 discusses a method for performing decimation of the recording data to reduce the discharge amount of ink having a predetermined color in accordance with the sum of the discharge amount of ink having the predetermined color and the discharge amounts of inks having different colors. According to this method, hue of the connecting area is determined on the basis of the discharge amount of ink having the predetermined color and the discharge amounts of inks having different colors. Then, the manner in which the decimation process is performed is changed in accordance with the hue of the connecting area, so that the image can be prevented from being degraded by the black lines.

The above-mentioned decimation process must be performed in parallel with a plurality of processes including processes for counting dots in a predetermined area, determining the hue, and calculating the amount of decimation. Therefore, a large processing load is placed on a control system, such as ASIC, which controls the overall operation of the recording apparatus. If the task of the conveyance-amount control process is added to the above-mentioned processing load, there is a risk that the recording speed will be reduced.

In the second conveyance-amount control process, the optimum rotational phase range for when the sheet is passed between the rollers in the sheet conveying operation is determined and the conveying roller is caused to wait at the standby stop phase. Therefore, the processing load of the second conveyance-amount control process is larger than that of the first conveyance-amount control process.

Therefore, according to the present embodiment, in the case where the decimation process for the boundary between the bands is performed, the first conveyance-amount control process is selected to reduce the processing load and reduce the possibility that the recording speed will be reduced.

The relationship between whether or not the decimation process is performed and the selection of the first conveyance-amount control process or the second conveyance-amount control process according to the present embodiment will be described with reference to FIG. 25. FIG. 25 is a diagram illustrating the relationship between the number of paths, whether or not the decimation process is performed, and the states of the conveyance-amount control processes for each of the recording qualities in the case where an image is recorded on normal paper.

Referring to FIG. 25, when the recording quality is set to "high speed" or "normal", the number of paths is 1. When the recording quality is set to "normal", the decimation process for the boundary between the bands is performed. When the recording quality is set to "high quality", the number of paths is 4 and the decimation process for the boundary between the bands is not performed. This is because since the amount of ink discharged in a single scanning process is reduced as the number of recording paths increases, the amount of ink which flows into the connecting area is small and the black lines are not easily formed.

As described above, according to the present embodiment, the band decimation process is performed only when "normal" is selected from the three recording qualities. Therefore, the first conveyance-amount control process is selected when the recording quality is set to "normal" and the second conveyance-amount control process is selected when the recording quality is set to "high speed" or "high quality."

The connecting area in which the black lines are formed corresponds to multiple nozzles in the case where the noise resolution is 600 dpi to 1,200 dpi, and this area is larger than the error in the amount of conveyance due to the eccentricity of the rollers. In other words, when the degradation of the image caused by the error in the amount of conveyance due to the eccentricity of the roller is compared with the degradation of the image caused by the black lines formed in the connecting area between the bands, the degradation caused by the black lines has a greater influence on the image. Therefore, according to the present embodiment, the single-path recording is performed when the recording quality is set to "high speed" or "normal", and the band decimation process is performed when the recording quality is set to "normal."

Figure 26:
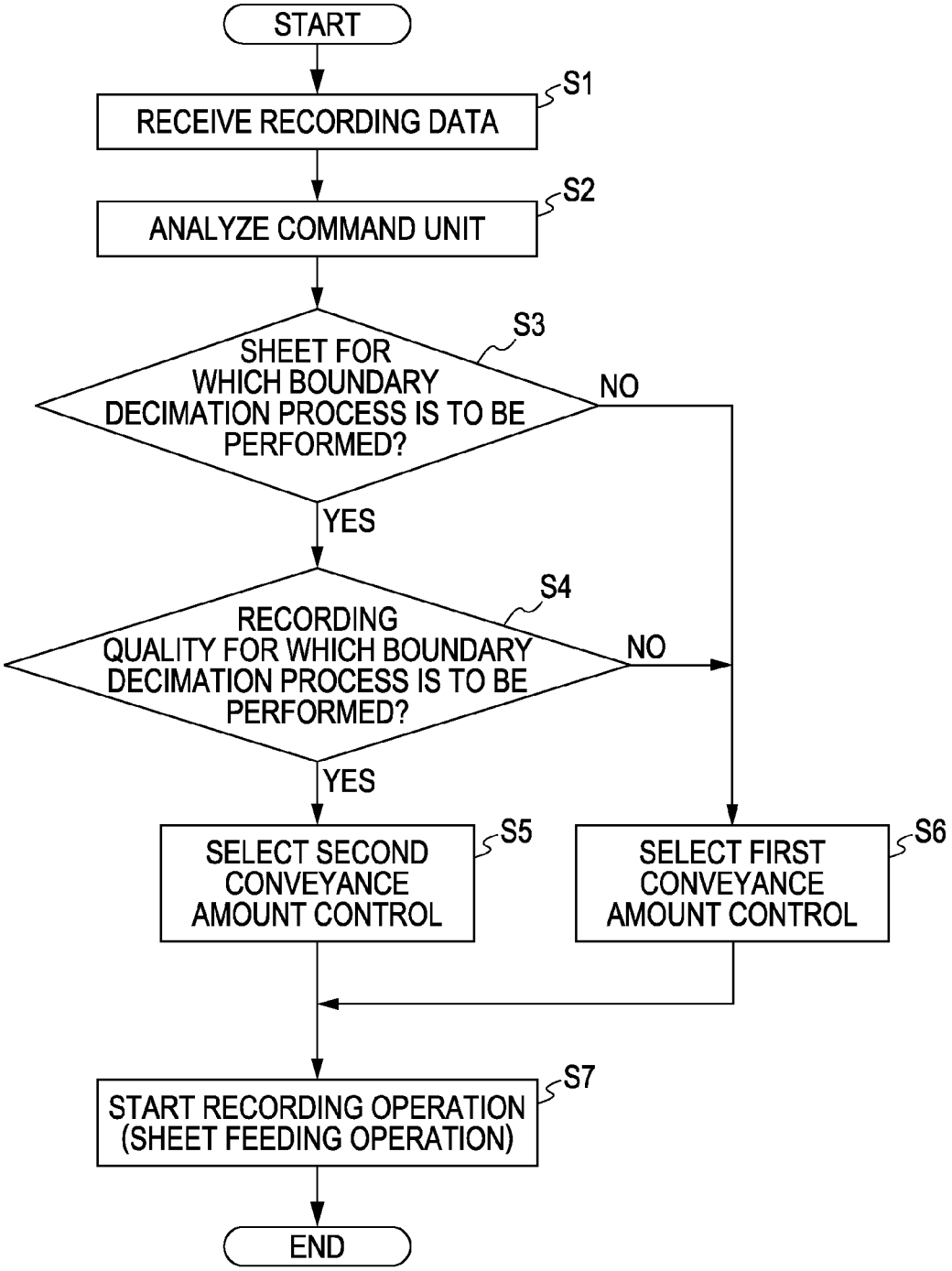
FIG. 26 is a flowchart of a process for selecting the conveyance-amount control process according to the second embodiment.

FIG. 26 is a flowchart of a sequence for selecting the conveyance-amount control process according to the present embodiment.

First, recording data is received in step S1. Then, in step S2, a command unit attached to the recording data is analyzed. Information representing the type of paper on which an image is to be recorded and the selected recording quality can be obtained by analyzing the command unit in step S2.

Next, in step S3, it is determined whether or not the type of paper on which an image is to be recorded is the type for which the band decimation process is performed. As described above, the problem that the black lines are formed in the connecting area between the bands is significant when an image is recorded on normal paper on which ink bleed easily occurs. In contrast, the black lines rarely appear on glossy paper or the like on which ink bleed does not easily occur. Therefore, for some types of paper, the band decimation process is not necessary. If it is determined in step S3 that the type of the recording medium is the type for which the band decimation process is necessary, the process proceeds to step S4. If it is determined that the type of the recording medium is the type for which the band decimation process is not necessary, the process proceeds to step S6 and the second conveyance-amount control process is selected.

In step S4, it is determined whether or not the selected recording quality is the recording quality for which the band decimation process is to be performed. In the present embodiment, if the selected recording quality is set to "normal", the process proceeds to step S5 and the first conveyance-amount control process is selected, as described above with reference to FIG. 25. If the recording quality is set to "high speed" or "high quality", the process proceeds to step S6 and the second conveyance-amount control process is selected.

Then, in step S7, the first conveyance-amount control process selected in step S6 or the second conveyance-amount control process selected in step S5 is performed in the recording operation.

In the present embodiment, the band decimation process is described as an example of an image process. However, the first conveyance-amount control process or the second conveyance-amount control process can also be selected in accordance with whether or not other kinds of image processes are executed.

Third Embodiment

In the third embodiment, whether or not there is image data in a predetermined area of a recording sheet is determined before the recording operation is started. That is, it is determined whether or not recording is performed within an interval in which the sheet is passed between the rollers in the sheet conveying direction. If there is no data to be recorded in the predetermined area, the first conveyance-amount control process is performed. More specifically, according to the present embodiment, the first conveyance-amount control process is selected if there is no recording data in a transitional area (area in which recording is performed within an interval in which the sheet is passed between the rollers in the sheet conveying operation). Accordingly, the processes including the process of stopping the conveying roller at the standby stop phase can be omitted and high-speed recording can be performed.

In the present embodiment, even if it is determined that the second conveyance-amount control process is to be selected on the basis of the recording quality (number of recording paths) or whether or not the image process is executed as in the above-described embodiments, the first conveyance-amount control process is selected if it is determined that there is no image data in a predetermined area of a recording sheet before the recording operation is started.

Figure 27:
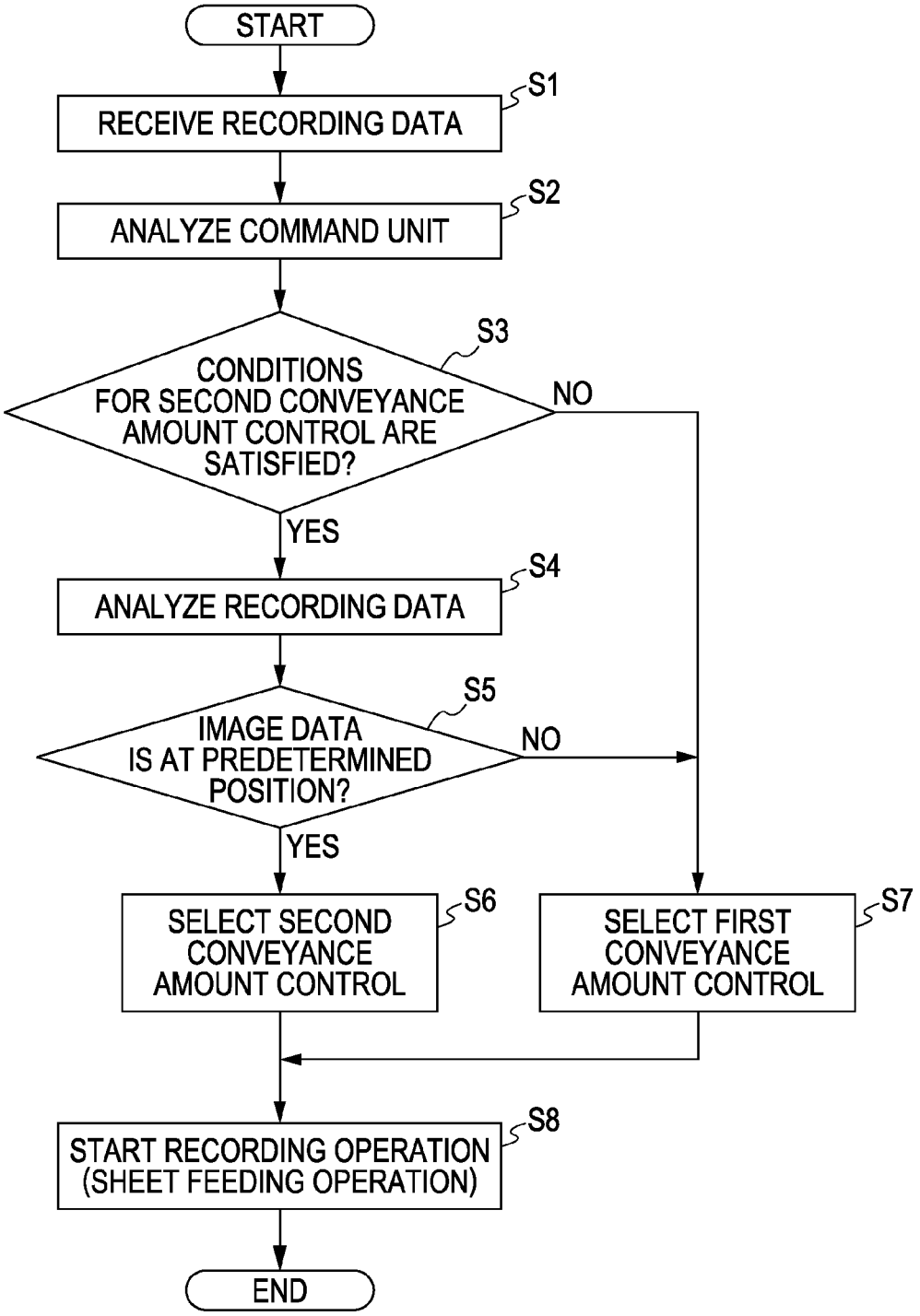
FIG. 27 is a flowchart of a process for selecting the conveyance-amount control process according to a third embodiment.

FIG. 27 is a flowchart of a process for selecting the conveyance-amount control process according to the present embodiment.

First, the recording data is received in step S1. Then, in step S2, a command unit attached to the recording data is analyzed. Information representing the type of paper on which an image is to be recorded and the selected recording quality can be obtained by analyzing the command unit in step S2. Next, in step S3, it is determined whether or not the second conveyance-amount control process is to be selected on the basis of the type of paper and the recording quality (number of recording paths). If it is determined in step S3 that the second conveyance-amount control process is to be selected, the process proceeds to step S4, where the recording data section included in the recording data is analyzed.

In step S5, it is determined whether or not there is recording data in a predetermined area (transitional area) on the basis of the analysis result of the recording data section. If it is determined in step S5 that there is recording data in the transitional area, the process proceeds to step S6 and the second conveyance-amount control process is selected.

If it is not determined that the second conveyance-amount control process is to be selected on the basis of the conditions in step S3 or if it is determined that there is no recording data in the transitional area in step S5, the first conveyance-amount control process is selected in step S7.

Then, in step S8, the first conveyance-amount control process selected in step S7 or the second conveyance-amount control process selected in step S6 is performed in the recording operation.

Fourth Embodiment

According to a fourth embodiment, in a recording apparatus capable of recording images not only on recording sheets but also on recordable CD-R and DVD-R (printable discs), the first conveyance-amount control process and the second conveyance-amount control process are selectively performed in accordance with the type of the recording medium.

Figure 28:
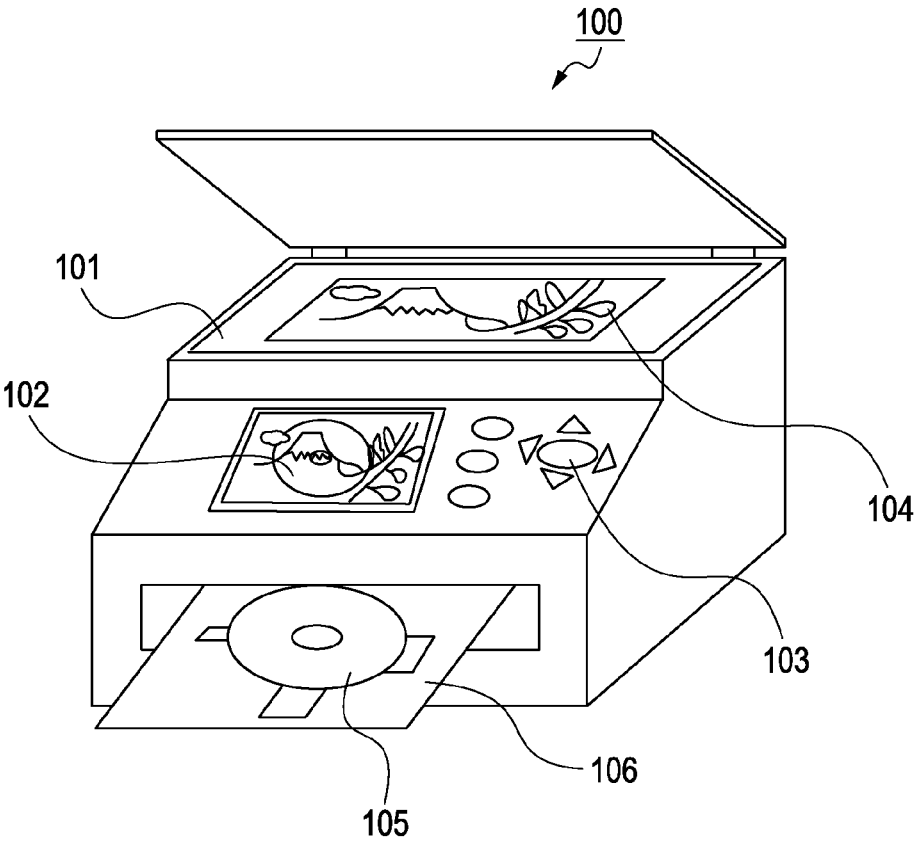
FIG. 28 is a perspective view of a mechanical section of a recording apparatus according to fourth end fifth embodiments.

FIG. 28 is a perspective view illustrating the structure of a recording apparatus according to the present embodiment.

A recording apparatus 100 according to the present embodiment is structured as a multifunction printer, and includes a reading device 101 which functions as a scanner. A viewer 102 functions as a display device for displaying an image read by the scanner, and a common liquid crystal monitor can be used as the viewer 102. A setting key unit 103 can be operated by a user to make various settings. The setting key unit 103 includes up, down, left, and right keys with which the image on the viewer can be moved, magnified, reduced, or trimmed. An image 104 to be read is formed on a document, such as a printed sheet or a photograph. An electronic information recording medium 105 is, for example, a medium such as a CD-R or a DVD-R on which an image can be recorded. The medium such as a CD-R or a DVD-R on which an image can be recorded will be hereinafter referred to also as a printable disc.

A tray 106 is structured such that an optical sensor (not shown) disposed in the recording apparatus can obtain information regarding the position of the electronic information recording medium 105, such as a CD-R or a DVD-R, with high accuracy before the recording process. The accuracy of the position information is ensured by, for example, providing a reflecting plate which shows the position information on the tray 106, changing colors, of forming holes in the tray 106.

Figure 29:
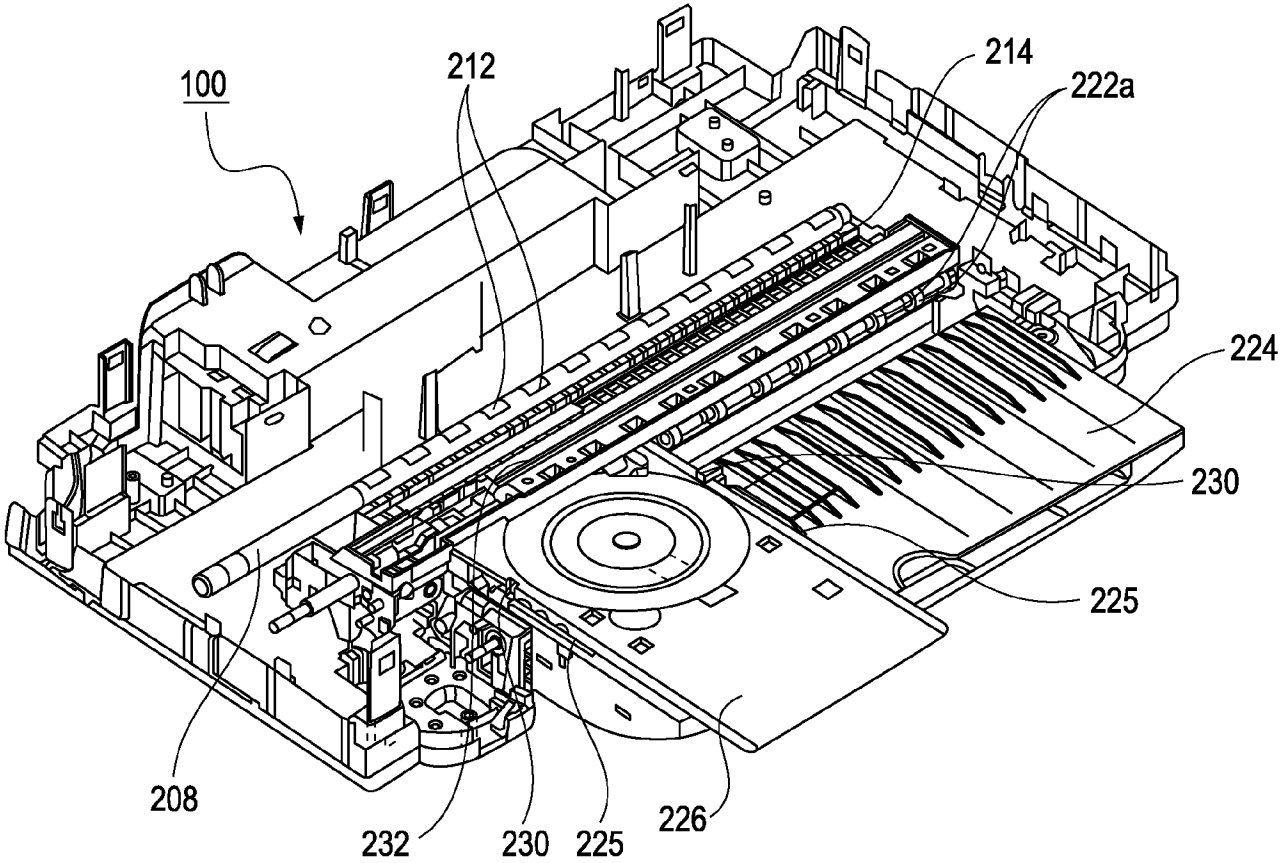
FIG. 29 is a schematic perspective view illustrating the manner in which a tray recording operation is performed in the recording apparatus show in FIG. 28.
Figure 30:
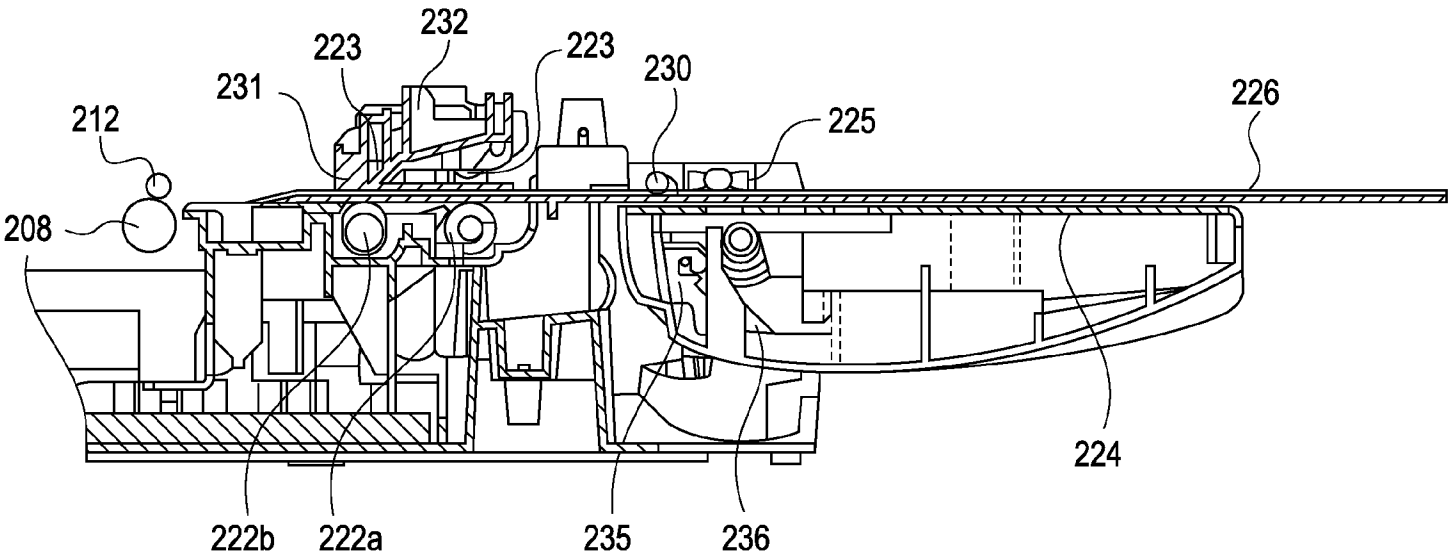
FIG. 30 is a sectional view illustrating the manner in which the tray recording operation is performed in the recording apparatus show in FIG. 28.

FIGS. 29 and 30 are a schematic perspective view and a sectional view, respectively, of a conveying mechanism of the recording medium in the state in which a tray recording process is performed using a tray. In the tray recording process, an image is recorded on a recording medium, such as a CD-R, placed on the tray. In the case where the tray recording process is performed using a tray 226, a paper ejection tray 224 is moved by a moving mechanism (not shown) from a normal recording position shown in FIG. 3 to a tray recording position at which the tray 226 can be conveyed. The paper ejection tray 224 is, of course, used also to hold recording sheets ejected in a normal recording operation.

In association with the movement of the paper ejection tray 224 to the tray recording position, a spur holder 232 is moved in a direction away from downstream and upstream ejection rollers 222*a* and 222*b* to a position where spurs 223 do not come into contact with a printing surface of the recording medium. Next, the recording medium, such as a CD-R, is placed in a recess formed in the tray 226 such that the printing surface faces upward.

Then, the tray 226 is placed on the paper ejection tray 224 at a conveyance start position. First, the tray 226 is inserted into the recording apparatus 100 along the top surface of the paper ejection tray 224 such that rail members provided along the left and right side edges of the tray 226 engage with respective angular U-shaped tray guides 225. The tray guides 225 are formed integrally with the paper ejection tray 224, and are symmetrical to each other in the left-right direction.

When the tray 226 is inserted, pressing rollers 230, which are provided on the paper ejection tray 224 and function as first urging members, move onto the top surfaces of the rail members of the tray 226. When the tray 226 is further inserted, the tray 226 moves onto the downstream ejection roller 222*a*. The top point of the downstream ejection roller 222*a* is positioned higher than the top surface of the paper ejection tray 224. The pressing rollers 230, which function as the first urging members, are rotatably supported by a pressing roller holder 235 and are urged toward the top surface of the paper ejection tray 224 by pressing roller springs 236. Accordingly, the tray 226 is pressed against the downstream ejection roller 222*a*, and the direction in which the front end of the tray 226 is moved is raised slightly upward with respect to the horizontal direction. Thus, the pressing rollers 230 which function as the first urging members for urging the tray 226 against the ejection roller 222*a* are positioned downstream of the ejection roller 222*a*.

When the tray 226 is further inserted, the front end of the tray 226 comes into contact with a pressing rib 231 which is formed integrally with the spur holder 232 and which function as a second urging member. The pressing rib 231 projects downward into the conveying path of the tray 226 from above. The position at which the front end of the tray 226 comes into contact with the pressing rib 231 is close to the upstream ejection roller 222*b* in the depth direction of the recording apparatus 100, and is at the position of one of the rail members of the tray 226 that is positioned outside the recording sheet in the normal recording operation in the width direction. Thus, the pressing rib 231 which urges the tray 226 against the ejection roller 222*a* is positioned between a conveying roller 208 and the ejection roller 222*a* in an area outside the side edge of a paper sheet with a largest width that can be stored in a sheet-feeding mechanism.

In the present embodiment, the pressing rib 231, which functions as the second urging member, is formed integrally with the spur holder 232 which functions as a driven roller supporter for supporting the spurs 223, which function as driven rollers that rotate by coming into contact with the ejection roller 222*a*.

The spur holder 232, which functions as a driven roller supporter, is urged by a spring (not shown) toward the downstream ejection roller 222*a* and the upstream ejection roller 222*b*. Therefore, when the tray 226 is further inserted, the pressing rib 231 moves onto the rail member while slightly bending the front end of the tray 226 downward. Therefore, the tray 226 receives an additional pressing force against the downstream ejection roller 222*a*. Then, when the front end of the tray 226 reaches a position near the midpoint between the upstream ejection roller 222*b* and the nip section between the conveying roller 208 and a pinch roller 212, the insertion of the tray 226 is stopped. The tray 226 is manually inserted to this position, and this position of the tray 226 is defined as a convey start position.

Then, the tray 226 is moved from the convey start position in a direction toward the upstream side in a normal recording operation by rotating the downstream ejection roller 222*a* in the reverse direction. Then, the tray 226 is nipped by the nip section between the conveying roller 208 and the pinch roller 212, which are also rotated in the reverse direction. Then, the tray 226 is conveyed to a recording position by the conveying roller 208, and an image is recoded on the recording medium placed on the tray 226, such as a CD-R tray. Then, the tray 226 on which the recording medium having the image recorded thereon is output to the paper ejection tray 224 by rotating the downstream ejection roller 222*a* in the forward direction.

Although not illustrated in FIGS. 28 to 30, the basic structure including the sheet conveying section and the sheet ejecting section for performing the recording operation are similar to those in the recording apparatus shown in FIG. 1.

FIGS. 31A and 31B are diagrams illustrating the number of pulses and the selection of the conveyance-amount control process in accordance with the type of the recording sheet and the recording quality according to the present embodiment.

FIG. 31A shows the case in which the recording sheet is photographic paper (glossy), and the second conveyance-amount control process is selected for all of the recording qualities.

FIG. 31B shows the case in which the recording sheet is a printable disc, and the first conveyance-amount control process is selected for all of the recording qualities.

As described above, in the case where an image is recorded on a printable disc using the recording apparatus according to the present embodiment, the tray on which the recording medium (disc) is placed is conveyed by the rollers. Therefore, in the area in which the image is being recorded on the printable disc, the tray is constantly conveyed by a plurality of rollers. As a result, the problem which occurs when the recording medium is passed between the rollers does not occur. Therefore, as shown in FIG. 31B, in the case where an image is recorded on a printable disc, the first conveyance-amount control process is performed in which the adjustment of the initial phase of the conveying roller is not necessary.

In the case where an image is recorded on a recording sheet, the recording medium is passed between the rollers in the sheet conveying operation and recording is performed within an interval in which the recording sheet is passed between the rollers. Therefore, in the present embodiment, if the recording medium is a recording sheet, the second conveyance-amount control process is selected in which the error in the amount of conveyance which occurs when the sheet is passed between the rollers in the sheet conveying operation can be reliably corrected.

Figure 32:
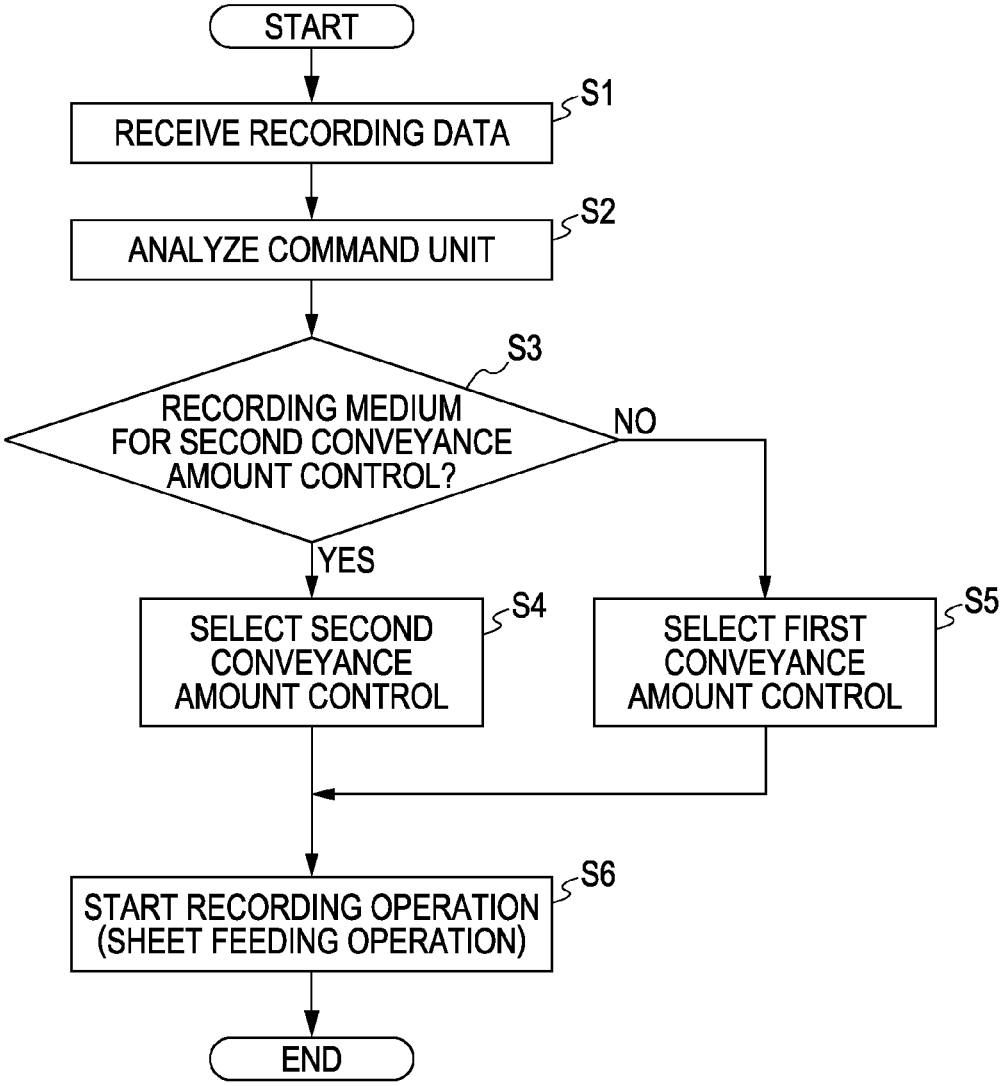
FIG. 32 is a flowchart of a process for selecting the conveyance-amount control process according to the fourth embodiment.

FIG. 32 is a flowchart of a sequence for selecting the conveyance-amount control process according to the present embodiment. First, the recording data is received in step S1. Then, in step S2, a command unit attached to the recording data is analyzed. Then, in step S3, it is determined whether or not the recording medium on which an image to be recorded is the recording medium for which the second conveyance-amount control process is to be selected on the basis of the analysis result. If the recording medium is a printable disc, the process proceeds to step S4 and the first conveyance-amount control process is selected. If the recording medium is a recording sheet, the process proceeds to step S5 and the second conveyance-amount control process is selected.

Then, in step S6, the first conveyance-amount control process selected in step S5 or the second conveyance-amount control process selected in step S4 is performed in the recording operation.

Fifth Embodiment

In a fifth embodiment, a copy function, which is one of the functions of a multifunction printer, is used. Similar to the recording apparatus described above with reference to FIGS. 28 to 30, the structure according to the present embodiment also has the copy function.

In the above-described third embodiment, it is determined whether or not there is image data in the transitional area on the basis of the recording data, and the first conveyance-amount control process is performed in the recording operation if there is no data to be recorded. In contrast, according to the present embodiment, the document to be copied is scanned, and it is determined whether or not the scanned image data includes image data in the transitional area before the scanned image data is converted into print data.

Figure 33:
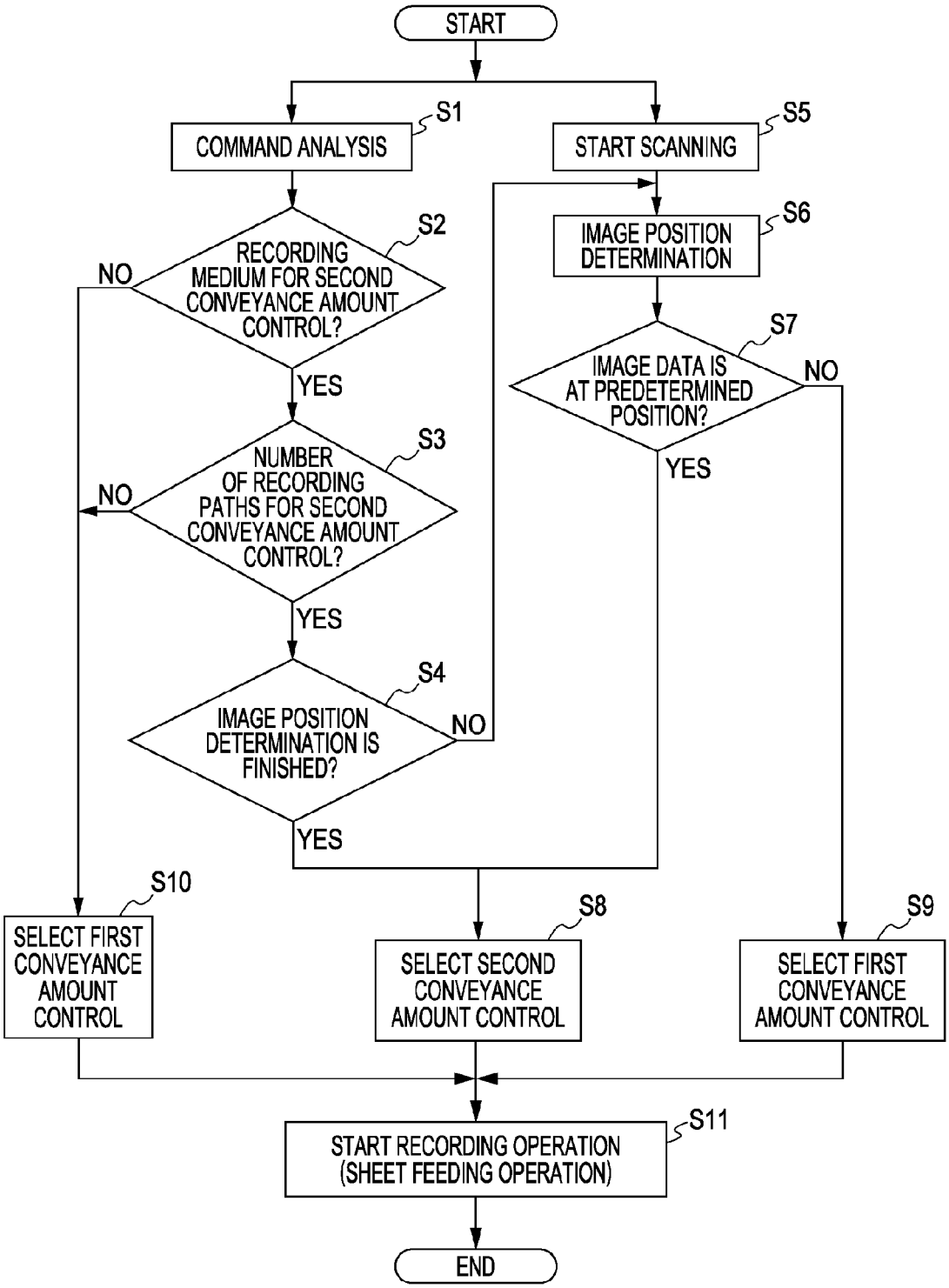
FIG. 33 is a flowchart of a process for selecting the conveyance-amount control process according to a fifth embodiment.

FIG. 33 is a flowchart of a process of selecting the conveyance-amount control process when a copy function is executed in the present embodiment.

First, the user sets the document to be scanned and sets the type of recording sheet, the recording quality, and the like. Then, the copying operation is started when the user presses a copy button. In step S1, commands of data regarding the information set by the user are analyzed. Then, in steps S2, and S3, it is determined whether or not the recording sheet and the recording quality (number of paths) are those for which the second conveyance-amount control process is to be performed. At the same time, in step S5, the process of scanning the document is started. Then, the position of the image is determined on the basis of the obtained data in step S6, and it is determined whether or not there is image data at the predetermined position (transitional area) in step S7.

If it is determined that the second conveyance-amount control process is to be performed in steps S2 and S3, and if it is determined that there is image data at the predetermined position in step S7, the second conveyance-amount control process is selected in step S8 after it is determined that the image position determination is finished in step S4. If it is determined that it is not necessary to perform the second conveyance-amount control process in any of the steps, the process proceeds to step S10 or S9 and the first conveyance-amount control process is selected.

Then, in step S11, the first conveyance-amount control process selected in step S9 or S10 or the second conveyance-amount control process selected in step S8 is performed in the recording operation.

What is claimed is:

1. A recording apparatus to record an image on a recording medium using a recording head, the recording apparatus comprising:

a first conveying roller configured to convey the recording medium, wherein the first conveying roller is positioned upstream of the recording head in a conveying direction;

a second conveying roller configured to convey the recording medium, wherein the second conveying roller is positioned downstream of the recording head in the conveying direction; and a controller configured to control a conveying operation of conveying the recording medium with the first conveying roller, wherein the controller selects a first conveying mode or a second conveying mode, wherein, in the first conveying mode, the controller performs a rotational phase control in which the controller controls rotational phases of the first conveying roller such that the recording medium is conveyed by a predetermined portion of circumference of the first conveying roller when a trailing end of the recording medium contacts the first conveying roller, and wherein, in the second conveying mode, the controller does not perform the rotational phase control.

2. The recording apparatus according to claim 1, wherein the controller obtains at least information about a recording speed, and wherein the controller selects the first conveying mode or the second conveying mode based on the obtained information about the recording speed.

3. The recording apparatus according to claim 2, wherein the information about the recording speed corresponds to a recording quality for the recording medium.

4. The recording apparatus according to claim 2, wherein the information about the recording speed corresponds to a number of recording paths in a multi-path recording operation.

5. The recording apparatus according to claim 1, wherein the controller is configured to perform a conveyance control process in which amounts of conveyance by the first conveying roller and the second conveying roller in the conveying operation in which the trailing end of the recording medium passes the first conveying roller are controlled based on a correction value.

6. The recording apparatus according to claim 1, wherein the controller selectively performs the first conveying mode and the second conveying mode based on whether there is data to be recorded when the trailing end of the recording medium passes the first conveying roller.

7. The recording apparatus according to claim 6, further comprising a scanner configured to read a document and obtain data, wherein the controller determines whether there is data to be recorded when the trailing end of the recording medium passes the first conveying roller based on data obtained by the scanner.

8. The recording apparatus according to claim 1, wherein a rotation period of the first conveying roller is equal to a rotation period of the second conveying roller.

9. The recording apparatus according to claim 8, wherein a driving force of the first conveying roller is transmitted to the second conveying roller through an idler gear.

10. The recording apparatus according to claim 1, wherein, in the first recording mode, the controller controls rotational phases of the first conveying roller such that the first conveying roller is at a predetermined rotational phase range at a timing when a reading end of the recording medium contacts the first conveying roller, and the predetermined rotational phase range is determined based on information about a length of the recording medium in the conveying direction.

11. The recording apparatus according to claim 1, wherein the predetermined portion of circumference of the first conveying roller is set such that a difference between a conveying speed by the first conveying roller and a conveying speed by the second conveying roller is smallest when the trailing end of the recording medium contacts the predetermined portion of the first conveying roller.

12. The recording apparatus according to claim 11, wherein the difference is smallest such that the conveying speed by the first conveying roller and the conveying speed by the second conveying roller are equal to each other when the trailing end of the recording medium contacts the predetermined portion of the first conveying roller.

13. A recording apparatus to record an image on a recording medium using a recording head, the recording apparatus comprising:

a first conveying roller configured to convey the recording medium, wherein the first conveying roller is positioned upstream of the recording head in a conveying direction;

a pinch roller configured to nip the recording medium in cooperation with the first conveying roller;

a second conveying roller configured to convey the recording medium, wherein the second conveying roller is positioned downstream of the recording head in the conveying direction; and a controller configured to control a conveying operation of conveying the recording medium with the first conveying roller, wherein the controller selects a first conveying mode or a second conveying mode, wherein, in the first conveying mode, the controller performs a rotational phase control in which the controller controls rotational phases of the first conveying roller such that the first conveying roller is at a predetermined rotational phase range when a trailing end of the recording medium passes a nip of the first conveying roller and the pinch roller, and wherein, in the second conveying mode, the controller does not perform the rotational phase control.

14. The recording apparatus according to claim 13, wherein the controller obtains at least information about a recording speed, and wherein the controller selects the first conveying mode or the second conveying mode based on the obtained information about the recording speed.

15. The recording apparatus according to claim 14, wherein the information about the recording speed corresponds to a recording quality for the recording medium.

16. The recording apparatus according to claim 14, wherein the information about the recording speed corresponds to a number of recording paths in a multi-path recording operation.

17. The recording apparatus according to claim 13, wherein the controller is configured to perform a conveyance control process in which amounts of conveyance by the first conveying roller and the second conveying roller in the conveying operation in which the trailing end of the recording medium passes the first conveying roller are controlled based on a correction value.

18. The recording apparatus according to claim 13, wherein the controller selectively performs the first conveying mode and the second conveying mode based on whether there is data to be recorded when the trailing end of the recording medium passes the nip.

19. The recording apparatus according to claim 18, further comprising a scanner configured to read a document and obtain data, wherein the controller determines whether there is data to be recorded when the trailing end of the recording medium passes the nip based on data obtained by the scanner.

20. The recording apparatus according to claim 13, wherein a rotation period of the first conveying roller is equal to a rotation period of the second conveying roller.

21. The recording apparatus according to claim 20, wherein a driving force of the first conveying roller is transmitted to the second conveying roller through an idler gear.

22. The recording apparatus according to claim 13, wherein, in the first recording mode, the controller controls rotational phases of the first conveying roller such that the first conveying roller is at a second predetermined rotational phase range at a timing when a reading end of the recording medium is nipped by the first conveying roller and the pinch roller, and the second predetermined rotational phase range is determined based on information about a length of the recording medium in the conveying direction.

23. The recording apparatus according to claim 13, wherein the predetermined rotational phase range of the first conveying roller is set such that a difference between a conveying speed by the first conveying roller and a conveying speed by the second conveying roller is smallest when the trailing end of the recording medium pass the nip of the first conveying roller and the pinch roller.

24. The recording apparatus according to claim 23, wherein the difference is smallest such that the conveying speed by the first conveying roller and the conveying speed by the second conveying roller are equal to each other when the trailing end of the recording medium passes the nip of the first conveying roller and the pinch roller.

* * * * *